US006980192B1

(12) United States Patent
Matsumura et al.

(10) Patent No.: US 6,980,192 B1
(45) Date of Patent: Dec. 27, 2005

(54) LIQUID CRYSTAL DISPLAY, INTEGRATED CIRCUIT FOR USE THEREIN, AND DRIVING METHOD AND DRIVER OF LIQUID CRYSTAL DISPLAY

(75) Inventors: Tatsuya Matsumura, Kumamoto (JP); Kazuo Aoki, Kumamoto (JP); Kenji Gondo, Kumamoto (JP)

(73) Assignee: Kabushiki Kaisha Advanced Display, Kumamoto (JP)

( * ) Notice: Subject to any disclaimer, the term of this patent is extended or adjusted under 35 U.S.C. 154(b) by 0 days.

(21) Appl. No.: 09/257,506

(22) Filed: Feb. 25, 1999

(30) Foreign Application Priority Data

Mar. 2, 1998 (JP) ..... P 10-049277
Mar. 13, 1998 (JP) ..... P 10-063686
Mar. 26, 1998 (JP) ..... P 10-079937

(51) Int. Cl.[7] ..... G09G 3/34
(52) U.S. Cl. ..... 345/99; 345/204
(58) Field of Search ..... 345/204, 205, 345/87, 92, 96, 99, 211, 212, 98

(56) References Cited

U.S. PATENT DOCUMENTS 4,724,433 A * 2/1988 Inoue et al. ..... 345/208
4,967,413 A * 10/1990 Otani ..... 371/37.4
5,038,139 A * 8/1991 Fujisawa et al. ..... 345/89
5,179,692 A * 1/1993 Inoue ..... 395/500
5,453,991 A * 9/1995 Suzuki et al. ..... 371/22.1
5,604,513 A * 2/1997 Takahashi et al. ..... 345/589
5,656,339 A * 8/1997 Wesseling et al. ..... 345/212
5,675,832 A * 10/1997 Ikami et al. ..... 713/600
5,726,674 A * 3/1998 Greve ..... 345/94
5,731,728 A * 3/1998 Greiss ..... 327/299
5,757,338 A * 5/1998 Bassetti et al. ..... 345/3
5,793,363 A * 8/1998 Takuwa ..... 345/205

(Continued)

FOREIGN PATENT DOCUMENTS

JP 64-68794 3/1989

(Continued)

*Primary Examiner*—Amr A. Awad
*Assistant Examiner*—Alecia D. Nelson
(74) *Attorney, Agent, or Firm*—McDermott Will & Emery LLP

(57) ABSTRACT

An integrated circuit including a liquid crystal display has a multi-port data output section from which output signals are arranged with respect to a data input signal. Points of changing the signals with respect to a time base are set with time delays that lag behind one another during one period of a reference internal clock signal to reduce the number of simultaneous changes of output signals. The electromagnetic field noise is reduced by a LCD driver when display data are transferred from a LCD timing controller to a source drive IC. The driver includes TFT drive and display timing control circuits that transfer red, green and blue color display data formed of plural bits to the TFT drive circuit for each bit unit formed of plural bits, optionally selected from each of the color display data. A delay unit in the display timing control circuit delays the transfer timing among bit units. A dedicated IC supplies image data to a source driver IC that drives a display section. A detector-comparator circuit detects a coincidence of polarity by comparing a polarity for each bit of red, green and blue of the image data from the dedicated IC. A control circuit outputs color data to the signal line when the coincidence of polarity has been detected. A control circuit outputs the color data that is restored from other data to the source driver IC when the coincidence of polarity of bit has been detected.

5 Claims, 22 Drawing Sheets

U.S. PATENT DOCUMENTS

| | | | | | |
|---|---|---|---|---|---|
| 5,870,294 | A | * | 2/1999 | Cyr | 363/41 |
| 5,889,819 | A | * | 3/1999 | Arnett | 375/270 |
| 6,000,035 | A | * | 12/1999 | Matsushima et al. | 713/320 |
| 6,046,735 | A | * | 4/2000 | Bassetti et al. | 345/204 |
| 6,144,242 | A | * | 11/2000 | Jeong et al. | 327/269 |
| 6,147,672 | A | * | 11/2000 | Shimamoto | 345/150 |
| 6,356,260 | B1 | * | 3/2002 | Montalbo | 345/204 |
| 6,437,768 | B1 | * | 8/2002 | Kubota et al. | 345/100 |
| 6,486,497 | B2 | * | 11/2002 | Misawa et al. | 257/72 |
| 6,600,771 | B1 | * | 7/2003 | Moon et al. | 375/130 |

FOREIGN PATENT DOCUMENTS

| | | |
|---|---|---|
| JP | 1-200396 | 8/1989 |
| JP | 6-95618 | 4/1994 |
| JP | 6-110412 | 4/1994 |
| JP | 6-161393 | 6/1994 |
| JP | 6-186930 | 7/1994 |
| JP | 6-289822 | 10/1994 |
| JP | 8-22267 | 1/1996 |

* cited by examiner

Fig 12

| | m | m+1 | m+2 | m+3 | m+4 | m+5 | m+6 | m+7 | m+8 | m+9 | m+10 | m+11 | m+12 | m+13 | m+14 | m+15 |
|---|---|---|---|---|---|---|---|---|---|---|---|---|---|---|---|---|
| n | RGB | RGB | RGB | RGB | RGB | RGB | RGB | RGB | RGB | RGB | RGB | RGB | RGB | RGB | RGB | RGB |
| n+1 | RGB | RGB | RGB | RGB | RGB | RGB | RGB | RGB | RGB | RGB | RGB | RGB | RGB | RGB | RGB | RGB |
| n+2 | RGB | RGB | RGB | RGB | RGB | RGB | RGB | RGB | RGB | RGB | RGB | RGB | RGB | RGB | RGB | RGB |
| n+3 | RGB | RGB | RGB | RGB | RGB | RGB | RGB | RGB | RGB | RGB | RGB | RGB | RGB | RGB | RGB | RGB |
| n+4 | RGB | RGB | RGB | RGB | RGB | RGB | RGB | RGB | RGB | RGB | RGB | RGB | RGB | RGB | RGB | RGB |
| n+5 | RGB | RGB | RGB | RGB | RGB | RGB | RGB | RGB | RGB | RGB | RGB | RGB | RGB | RGB | RGB | RGB |
| n+6 | RGB | RGB | RGB | RGB | RGB | RGB | RGB | RGB | RGB | RGB | RGB | RGB | RGB | RGB | RGB | RGB |
| n+7 | RGB | RGB | RGB | RGB | RGB | RGB | RGB | RGB | RGB | RGB | RGB | RGB | RGB | RGB | RGB | RGB |
| n+8 | RGB | RGB | RGB | RGB | RGB | RGB | RGB | RGB | RGB | RGB | RGB | RGB | RGB | RGB | RGB | RGB |
| n+9 | RGB | RGB | RGB | RGB | RGB | RGB | RGB | RGB | RGB | RGB | RGB | RGB | RGB | RGB | RGB | RGB |
| n+10 | RGB | RGB | RGB | RGB | RGB | RGB | RGB | RGB | RGB | RGB | RGB | RGB | RGB | RGB | RGB | RGB |
| n+11 | RGB | RGB | RGB | RGB | RGB | RGB | RGB | RGB | RGB | RGB | RGB | RGB | RGB | RGB | RGB | RGB |

Fig 13

| | m+4 | | | m+5 | | | m+6 | | | m+7 | | |
|---|---|---|---|---|---|---|---|---|---|---|---|---|
| n | R | G | B | R | G | B | R | G | B | R | G | B |
| n+1 | R | G | B | R | G | B | R | G | B | R | G | B |
| n+2 | R | G | B | R | G | B | R | G | B | R | G | B |
| n+3 | R | G | B | R | G | B | R | G | B | R | G | B |

Fig 17

| | m+4 | | | m+5 | | | m+6 | | | m+7 | | |
|---|---|---|---|---|---|---|---|---|---|---|---|---|
| n | R | G | B | R | G | B | R | G | B | R | G | B |
| n+1 | R | G | B | R | G | B | R | G | B | R | G | B |
| n+2 | R | G | B | R | G | B | R | G | B | R | G | B |
| n+3 | R | G | B | R | G | B | R | G | B | R | G | B |

LIQUID CRYSTAL DISPLAY, INTEGRATED CIRCUIT FOR USE THEREIN, AND DRIVING METHOD AND DRIVER OF LIQUID CRYSTAL DISPLAY

BACKGROUND AND SUMMARY OF THE INVENTION

1. Industrial Field

The present invention relates to a liquid crystal display and to an integrated circuit having a multi-port data output section.

The invention relates also to a driving method and a driver of liquid crystal display such as active matrix drive system and, more particularly, the reduction of EMI in a TFT liquid crystal display (hereinafter referred to as TFT-LCD panel).

The invention relates further to a liquid crystal display and, more particularly, to delivery of signal between a dedicated IC for driving the liquid crystal display and a source driver IC.

2. Prior Arts

1) Generally, a system in which frequency of data output signals is lowered and total number of the data output signals is increased with respect to data input signals, is called multi-port output. For example, when a frequency of data output signals is half of that of a data input signal and total number of the data output signals is twice as many as that of the data input signals, it is called two-port output.

In the arrangement of an electric circuit of a liquid crystal display, when an integrated circuit for generating display data output signals of two-ports is required, an internal clock signal used as a clock signal of a latch circuit located immediately before the display data output section in the integrated circuit is usually generated through a divider circuit for dividing into two frequencies to which a clock input signal is inputted, lowering a frequency thereof to be a half of the frequency of the clock input signals.

In the output section, the clock output signal is generated with the same phase as the point of changing the internal clock signal, and the display data output signals are generated so as to change with a time lag by a half frequency of the clock output signal (by a period "H" or a period "L") from an active edge of the clock output signal serving as an edge for latching in the source driver IC.

This means that the display data output signals are generated so as to change simultaneously at the same point as the active edge of one type of internal clock signal which is an edge for latching the data with the internal clock signal in the circuit.

FIG. 22 shows diagrams respectively illustrating, in the form of voltage waveform, a relation between the input and output signal sections in the above-mentioned conventional integrated circuit for generating the mentioned two port-display data output signals. In the diagrams, reference numeral 1 indicates a clock input signal, numeral 2 indicates a display data input signal, numeral 3 indicates an internal clock signal, numeral 4 indicates a clock output signal, and numeral 5 indicates a display data output signal. Period of the display data input signal 2 is equal to the period 1CLKI of the clock input signal 1, and period of the display data output signal 5 is equal to the period 1CLK of the internal clock signal 3 and to the period 1CLKO of the clock output signal 4. 1CLK is a duration equivalent to 2CLKI, and 1CLKO is a duration equivalent to 2CLKI. Arrows of the internal clock signal 3 indicate active edges (trailing edge in the diagram) of the latch circuit located immediately before the display data output section in the integrated circuit, and arrows of the clock output signal 4 indicate active edges (leading edge in the diagram) of the latch circuit located immediately after the display data input section in the source driver IC to which the display data output signal 5 is outputted.

In the arrangement of electric circuit for any other system than the liquid crystal display, when an integrated circuit for generating a data output signal of multi-port having two ports or more with respect to the data input signal is required, usually, the internal clock signal in the integrated circuit is generated in the same manner as the foregoing through a divider circuit such that frequency thereof is an inverse number of a value obtained by multiplying the number of output ports by an integer.

In the output section, the data output signal is generated so as to change simultaneously at the same point as the active edge of the internal clock signal which is an edge for latching the data with a type of internal clock signal in the circuit.

FIG. 23 shows diagrams respectively illustrating, in the form of voltage waveform, a relation between the input and output signal sections in the above-mentioned conventional integrated circuit for generating a data output signal of multiple ports (n ports: n is an optional integer) having two ports or more. In the diagrams, reference numeral 1 indicates a clock input signal, numeral 3 indicates an internal clock signal, numeral 4 indicates a clock output signal, numeral 6 indicates a data input signal, and numeral 7 indicates a data output signal. Period of the data input signal 6 is equal to the period 1CLKI of the clock input signal 1, and period of the data output signal 7 is equal to the period 1CLK of the internal clock signal 3 and to the period 1CLKO of the clock output signal 4. 1CLK is a duration equivalent to nCLKI, and 1CLKO is a duration equivalent to nCLKI. Arrows of the internal clock signal 3 indicate active edges (trailing edge in the diagram) of the latch circuit located immediately before the data output section in the integrated circuit, and arrows of the clock output signal 4 indicate active edges (leading edge in the diagram) of the latch circuit located immediately after the data input section in the circuit to which the data output signal is outputted. However, the clock input signal 1 and the clock output signal 4 are not always set in the form of input and output terminals.

2) FIG. 24 is a simple block diagram of a driver circuit for a TFT-LCD panel, and in which reference numeral 218 indicates a TFT-LCD panel, numeral 215 indicates a TFT source line driver circuit (hereinafter referred to as source driver) for displaying the TFT-LCD panel, numeral 217 indicates a TFT gate line driver circuit (hereinafter referred to as gate driver) for displaying the TFT-LCD panel, numeral 211 indicates a display timing control circuit (hereinafter referred to as LCD timing controller) for generating various data and timing signals necessary for display operation and outputting them to the source driver 215 and to the gate driver 217, numeral 212 indicates a data bus for transferring, for example, a red display data (hereinafter referred to as R data) from the LCD timing controller to the source driver 215, numeral 213 is a data bus for transferring, for example, a green data (hereinafter referred to as G data), and numeral 214 is a data bus for transferring, for example, a blue data (hereinafter referred to as B data). Numeral 216 indicates a transfer clock signal line for transferring the display data of R, G, B from the LCD timing controller 211 to the source driver 215.

Detailed description of the entire operation of the arrangement shown in FIG. 24 is herein omitted, and the operation according to the invention is briefly described below. Referring to FIG. 24, in case of SVGA, for example, in the TFT-LCD panel 218, there exist 600 lines (trains) in each of which 800 picture elements composed of red, green and blue liquid crystal cells are arranged in a row.

The source driver IC 215 takes, synchronously with the clock for data transfer, the display data of the 800 picture elements sent by each data bus 212, 213, 214 of R, G, B from the LCD timing controller 211, and outputs the display data to the picture element lines of the TFT-LCD panel 218 after converting them to a voltage. At this time, the voltage outputted from the source driver IC 215 is taken into one picture element line specified from among the 600 lines by the gate driver IC 217. This operation is performed 600 times to complete the display of one picture of panel. Generally, rewriting operation of the picture is performed 60 times per second.

FIG. 25 is a diagram showing timing waveforms of the data bus when each data of R, G, B is transferred from the LCD timing controller 211 to the TFT source driver in FIG. 24.

In this example, to reproduce 64 gradations for each color R, G, B, each of the RGB data is formed by a data bus of 6 bits.

Generally, to change the data on these RGB data buses, all buses are changed simultaneously with the transfer clock 216. Since the source driver IC 215 takes the data synchronously with the transfer clock 216 (leading edge of the transfer clock 216 in this example), to make easy the timing control (to secure data setup and data hold timing), all data are changed at the edge reverse to the edge of the transfer clock where the data are taken by the source driver IC 215 (at the trailing edge in this example), as shown in FIG. 25.

Generally in the SVGA panel, frequency of the transfer clock is so high as to be about 40 MHz, and the RGB data, each being 6 bits and 18 bits in total, are changed in a short period of about 25 nS depending on the contents thereof.

The RGB display data output circuit of the LCD timing controller IC 211, the RGB data buses, and the source driver IC 215 connected to the output circuit of the LCD timing controller IC 211 respectively shown in FIG. 24 can be shown in the form of a simple equivalent circuit as shown in FIG. 26.

In this equivalent circuit, the RGB data buses and the source driver IC are shown as capacity load. That is, in FIG. 26, reference numeral 204 indicates a load capacity obtained by aggregating a wiring capacity of the R data bus 212 and an input capacity of the plural source driver ICs 215 connected to the R data bus, numeral 205 indicates a load capacity obtained by aggregating a wiring capacity of the G data bus 213 and an input capacity of the plural source driver ICs 215 connected to the G data bus 213, and numeral 206 indicates a load capacity obtained by aggregating a wiring capacity of the B data bus 214 and an input capacity of the plural source driver ICs 215.

Among the output circuits for outputting the RGB data in the LCD timing controller IC 211, numeral 201 indicates an output circuit for outputting the R data, numeral 202 indicates an output circuit for outputting G data, and numeral 203 indicates an output circuit for outputting B data.

It is to be noted that, though the display data of RGB are respectively formed of 6 bits in this example, the data output circuits and capacity load are shown each by 1 bit of RGB in FIG. 26.

3) In most of the conventional liquid crystal displays, an output from the dedicated IC is either outputted to the source driver IC as it is or outputted by inverting the polarity when a half number of data are simultaneously changed.

FIG. 28 is a block diagram showing the delivery of signals between the dedicated IC and the source driver IC in the conventional liquid crystal display.

In the diagram, reference numeral 301 indicates an internal bus for transmitting data of $\mathbf{301}_1$ to $\mathbf{301}_n$ bits. Numeral 302 indicates a selector to which data on the internal bas 301 is inputted, and in which selectors $\mathbf{302}_1$ to $\mathbf{302}_n$ are provided corresponding to the internal bus 301 and each being composed of an exclusive OR circuit of two inputs.

Numeral 303 indicates a register of n bits composed of registers $\mathbf{301}_1$ to $\mathbf{303}_n$ to which output of the selector section 302 is inputted. Numeral 304 indicates an output buffer section composed of output buffers $\mathbf{304}_1$ to $\mathbf{304}_n$ corresponding to the register 303 and to which data of the register section 303 are inputted, and numeral 305 indicates an output pin composed of output pins $\mathbf{305}_1$ to $\mathbf{305}_n$ corresponding to the output buffer 304 and from which data of the output buffer 304 are outputted to external buses.

Numeral 306 indicates a comparative majority circuit which compares the data of the internal bus 301 and outputs a judgment output signal J for setting the selector 302 to inversion mode. Numeral 307 indicates an exclusive OR circuit of the selector 302, numeral 308 indicates a toggle type flip-flop for outputting a polarity display signal P through an output buffer 309 and an output pin 310. Numeral 311 indicates a clock signal line through which a clock signal CK is transmitted, and numeral 312 indicates a reset signal line.

In the conventional signal delivery circuit of above arrangement, the selector 302 transmits the signal on the internal bus 301, with its polarity as it is or inverted, as an input to the register 303. The registers $\mathbf{303}_1$ to $\mathbf{303}_n$ of n bits are initialized to "0" output state by the reset signal R and takes the input data synchronously with the clock signal CK given for each switching of the output from the clock signal line 311.

At this time, the comparative majority circuit 306 compares the input data for each bit corresponding to the data inputted for each switching of the output from the internal bus 301 of the register 303, and only when number of different data is larger than that of equal data, the judgment output signal J is changed to "1" level, and the selector 302 is set to the inversion mode. This judgment output signal J and the polarity display signal P from the toggle type flip-flop 308 are inputted to the exclusive OR circuit 307, and the output from the exclusive OR circuit 307 is inputted to the toggle type flip-flop 308. The toggle type flip-flop 308 is initialized by receiving the reset signal R, and the stage is inverted by receiving the clock signal CK when the output from the exclusive OR circuit 307 is "1".

3. Problems to be Solved by the Invention

1) As described above, as a result of changing the data output signal of multi-ports having two ports or more only at one point where is the same point as the active edge of the internal clock signal, which is an edge for latching the data with the internal clock signal to one type of internal clock signal during one period of the internal clock signal, in other words, as a result of simultaneously changing every data output signal only at one point with respect to the time base, a momentary current generated from the output buffer at the time of changing the data output section is superposed at the same one point with respect to the time base and increased corresponding to number of output signals. Therefore, a problem exists in that electromagnetic wave noise in the input/output signal section and unnecessary electromagnetic interference (EMI) negatively affecting other system and circuit are enhanced.

The invention was made to solve the above-discussed problem and has an object of providing an integrated circuit having a liquid crystal display of high quality and amulti-port data output section and in which electromagnetic wave noise in the input/output signal section and unnecessary electromagnetic interference negatively affecting the other system or circuit are reduced.

2) FIG. 27 shows a voltage waveform of respective RGB data buses 212, 213, 214 when RGB data referring to FIG. 26 are transmitted.

In case of changing each RGB data to L, H, L synchronously with the trailing edge of the data transfer clock, when the data are changed from L to H, currents Ic1, Ic2, Ic3 for charging the load capacities 204, 205, 206 flow to each data bus, and when the data are changed from H to L, currents Id1, Id2, Id3 for discharging the load capacities flow to each data bus.

As these currents flow to a power source of IC 211 and to GND through the output circuit of the LCD timing controller IC 211, after all, a sum of these currents flows to the power source line inside and outside of the LCD timing controller IC 211 and to the GND line.

Accordingly, as shown in FIG. 27, in the simultaneous change of 18 bits in total of each RGB data bus, on condition that Ic1=Ic2=Ic3=Ic and Id1=Id2=Id3=Id, when the RGB data have changed from L to H, a large current 18 times as much as Ic comes to flow, and when the RGB data have changed from H to L, a large current 18 times as much as Id comes to flow to the power source line of the LCD timing controller IC and to the GND line.

In the charge and discharge of capacity load, particularly in the charge and discharge of a large current, a large change of electromagnetic field, i.e., an electromagnetic field noise occurs in and around the current path.

For example, it is estimated that the electromagnetic field noise occurring when all bits of the 18 bit data have been changed simultaneously at the clock period of 40 MHz reaches a fairly high level, and in fact there arises a problem such that a long time and a large amount of labor and cost must be spent to satisfy the standard on EMI in the TFT-LCD panel.

Accordingly, another object of the invention is to provide a data transfer method capable of reducing the mentioned electromagnetic field noise at the time of transferring display data from the LCD timing controller to the source driver IC in the TFT-LCD panel.

3) The delivery of data between the dedicated IC and the source driver IC is performed in the mentioned manner in the conventional liquid crystal display, and in which the data are inverted by the selectors only when polarity of more than half of n bits has been simultaneously changed.

For example, supposing 6 bit data most popularly used in the liquid crystal display, as red, green and blue have respectively 6 bits, total data number becomes 6×3 18, and therefore the inversion of data takes place when the majority of data (10 data or more) has been simultaneously changed.

Recently, the noise in the simultaneous change is a serious problem in view of preventing EMI. Such a conventional improvement is certainly effective when respective 6 bits of red, green and blue have been simultaneously changed, but the effect of changing only one data is shown even when 10 data have been changed.

In the conventional liquid crystal display, since the delivery of data between the dedicated IC and the source driver IC is performed in the mentioned manner, the simultaneous change of majority of data output signals is an essential condition for the inversion of data.

The invention was made to solve the above-discussed problem and has an object of providing a liquid crystal display capable of reducing number of simultaneous changes of data output signals by detecting a change between the data.

4. Means of Solution to the Problems

1) To accomplish the foregoing objects, there is provided according to the invention an integrated circuit in which multi-port data output signals are generated with respect to a data input signal, and points of changing said data output signals with respect to a time base are set with a time lag one another during one period of a reference internal clock signal, so that number of simultaneous changes of display data output signals is reduced.

It is preferable that, in the mentioned arrangement, the points of changing the data output signals with respect to the tame base are set to points respectively delayed from an active edge of the clock output signal by 0.5 period, 1 period, and 1.5 period of the data input signal.

It is preferable that the points of changing the data output signals with respect to the tame base are set to points respectively having a time lag one another from the active edge of the clock output signal by optional integer times as long as a half period of the data input signal.

It is preferable that the points of changing the data output signals with respect to the time base are set to points respectively having a time lag one another from the active edge of the clock output signal by optional integer times as long as a half period of the data input signal and by a delay time produced by a delay circuit added to the optional integer times as long as a half period of the data input signal.

There is also provided according to the invention an integrated circuit in which multi-port display data output signals are generated with respect to a data input signal, and points of changing said display data output signals with respect to a time base are set respectively having a time lag one another during one period of a clock output signal or a reference internal clock signal having a same phase as the clock output signal, so that number of simultaneous changes of display data output signals is reduced.

It is preferable that, in the mentioned arrangement, the points of changing the display data output signals with respect to the time base are set to points respectively delayed from an active edge of the clock output signal by 0.5 period, 1 period, and 1.5 period of the clock input signal or the display data input signal.

It is preferable that the points of changing the display data output signals with respect to the time base are set to points respectively having a time lag one another from the active edge of the clock output signal by optional integer times as long as a half period of the clock input signal or the display data input signal.

It is preferable that the points of changing the display data output signals with respect to the time base are set to points respectively having a time lag one another from the active edge of the clock output signal by optional integer times as long as a half period of the clock input signal or the display data input signal and by a delay time produced by a delay circuit added to the integer times as long as the half period of the clock input signal or the display data input signal.

2) There is provided according to the invention a driving method of a liquid crystal display in which when red, green and blue color display data composed of plural bits are transferred from a display timing circuit to a TFT drive circuit for driving a TFT liquid crystal panel to display, each transfer is performed with a time lag little by little for each bit unit formed of plural bits optionally selected from each of said color display data.

It is preferable that the bit unit is formed for each of red, green and blue color display data.

It is preferable that each bit unit has a part of the plural bits forming the red, green and blue color display data.

It is preferable that the bit unit is transferred with a time lag of 2 nanoseconds or longer.

A driver of a liquid crystal display according to the invention comprises: a TFT drive circuit for driving a TFT liquid crystal panel to display; a display timing control circuit for transferring red, green and blue color display data formed of plural bits to the TFT drive circuit for each bit unit formed of plural bits optionally selected from each of the color display data; and a delay unit provided in the display timing control circuit to delay the transfer timing between one bit unit and another.

3) A liquid crystal display according to the invention comprises: a data supply circuit for supplying image data through a signal line to a drive circuit for driving a display section; a detector circuit for detecting a coincidence of polarity by comparing a polarity of bit for each predetermined group of image data outputted by the data supply circuit; a first control circuit for outputting the data of the group represented by certain data to the signal line when the coincidence of polarity has been detected by the detector circuit; and a second control circuit for outputting the data of the group restored from the certain data of the signal line to the drive circuit when the coincidence of polarity of bit has been detected by the detector circuit.

It is preferable that the predetermined group of image data are red, green and blue data.

It is preferable that the certain data are red data.

It is preferable that the first control circuit controls the predetermined group of data to be a low potential, except the certain data.

It is also preferable that the second control circuit forms the predetermined group of data to be same as the certain data.

5. Advantages of the Invention

1) As a result of employing the arrangement described above according to the invention, it is now possible to provide an integrated circuit having a liquid crystal display of high quality and a data output section of multi-ports and in which electromagnetic wave noise in the input/output signal section and unnecessary electromagnetic interference negatively affecting the other system or circuit are reduced.

It is also possible that, as a result of reducing the simultaneous change of the data output signals by generating the multi-port data output signals and by setting the points of changing the display data output signals with respect to the tame base to plural two or three points respectively delayed by 0.5 period, 1 period, and 1.5 period of the clock input signal during one period of the clock output signal, amount of change at each point with respect to a momentary current generated from the entire output buffer at the time of changing the data output signals of the data output section is reduced, whereby electromagnetic wave noise in the input/output signal section and unnecessary electromagnetic interference (EMI) negatively affecting other system and circuit are reduced.

It is also possible that, as a result of reducing the simultaneous change of the data output signals by generating the multi-port data output signals and by setting the points of changing the display data output signals with respect to the tame base to plural points with a time lag one another by optional integer times as long as a half period of the clock input signal during one period of the reference internal clock signal, amount of change at each point with respect to a momentary current generated from the entire output buffer at the time of changing the data output signals of the data output section is reduced, whereby electromagnetic wave noise in the input/output signal section and unnecessary electromagnetic interference (EMI) negatively affecting other system and circuit are reduced.

It is also possible that, as a result of reducing the simultaneous change of the data output signals by generating the multi-port data output signals and by setting the points of changing the display data output signals with respect to the time base to plural points with a time lag one another by optional integer times as long as a half period of the clock input signal during one period of the reference internal clock signal and by a delay time produced by a delay circuit added to the integer times as long as the half period, amount of change at each point with respect to a momentary current generated from the entire output buffer at the time of changing the data output signals of the data output section is reduced, whereby electromagnetic wave noise in the input/output signal section and unnecessary electromagnetic interference (EMI) negatively affecting other system and circuit are reduced.

2) In the drive method of a liquid crystal display according to the invention, when the display data of RGB are transferred from the LCD timing controller IC to the source driver, since the points (timings) for changing RGB data buses respectively have a time lag little by little so as not to change the R data bus, G data bus and B data bus simultaneously, even if all of the RGB data bits are changed from L to H or from H to L, the current flowing at that time is dispersed, whereby electromagnetic field noise can be reduced.

Further, when the display data of RGB are transferred from the LCD timing controller IC to the source driver, since the bus width of the respective RGB data buses is divided from more significant bits by plural bit unit and the points (timings) of change respectively have a time lag between one divided data bit unit and another, even if all of the RGB data bits are changed from L to H or from H to L, the current flowing at that time is dispersed, whereby electromagnetic field noise can be reduced.

Furthermore, when the display data of RGB are transferred from the LCD timing controller IC to the source driver, since the optimum time lag amount in the points (timings) for changing the respective RGB data buses is set to 2 nanoseconds or longer, electromagnetic field noise can be reduced without occurring any trouble in the data sampling of the source driver IC.

3) The liquid crystal display of above arrangement can perform following advantages.

Since the liquid crystal display comprises a data supply circuit for supplying image data through a signal line to a drive circuit for driving a display section; a detector circuit for detecting a coincidence of polarity by comparing a polarity of bit for each predetermined group of image data outputted by the data supply circuit; a first control circuit for outputting the data of the group represented by certain data to the signal line when the coincidence of polarity has been detected by the detector circuit; and a second control circuit for outputting the data of the group restored from the certain data of the signal line to the drive circuit when the coincidence of polarity of bit has been detected by the detector circuit; the simultaneous change of polarity can be reduced.

Since a predetermined group of image data are red, green and blue data, the data can be processed by each picture element.

Since the certain data are red data, all of the data can be covered by ⅓ data for each picture element.

Since the first control circuit controls the predetermined group of data to be a low potential, except the certain data, change of polarity can be reduced.

Since the second control circuit forms the predetermined group of data to be same as the certain data, the data can be easily restored.

BRIEF DESCRIPTION OF THE DRAWINGS

FIG. 12 is a diagram to explain the Example 6.

FIG. 13 is a diagram to explain the Example 6.

FIG. 17 is a diagram to explain the Example 6.

DESCRIPTION OF THE PREFERRED EMBODIMENTS

Example 1

Figure 1:
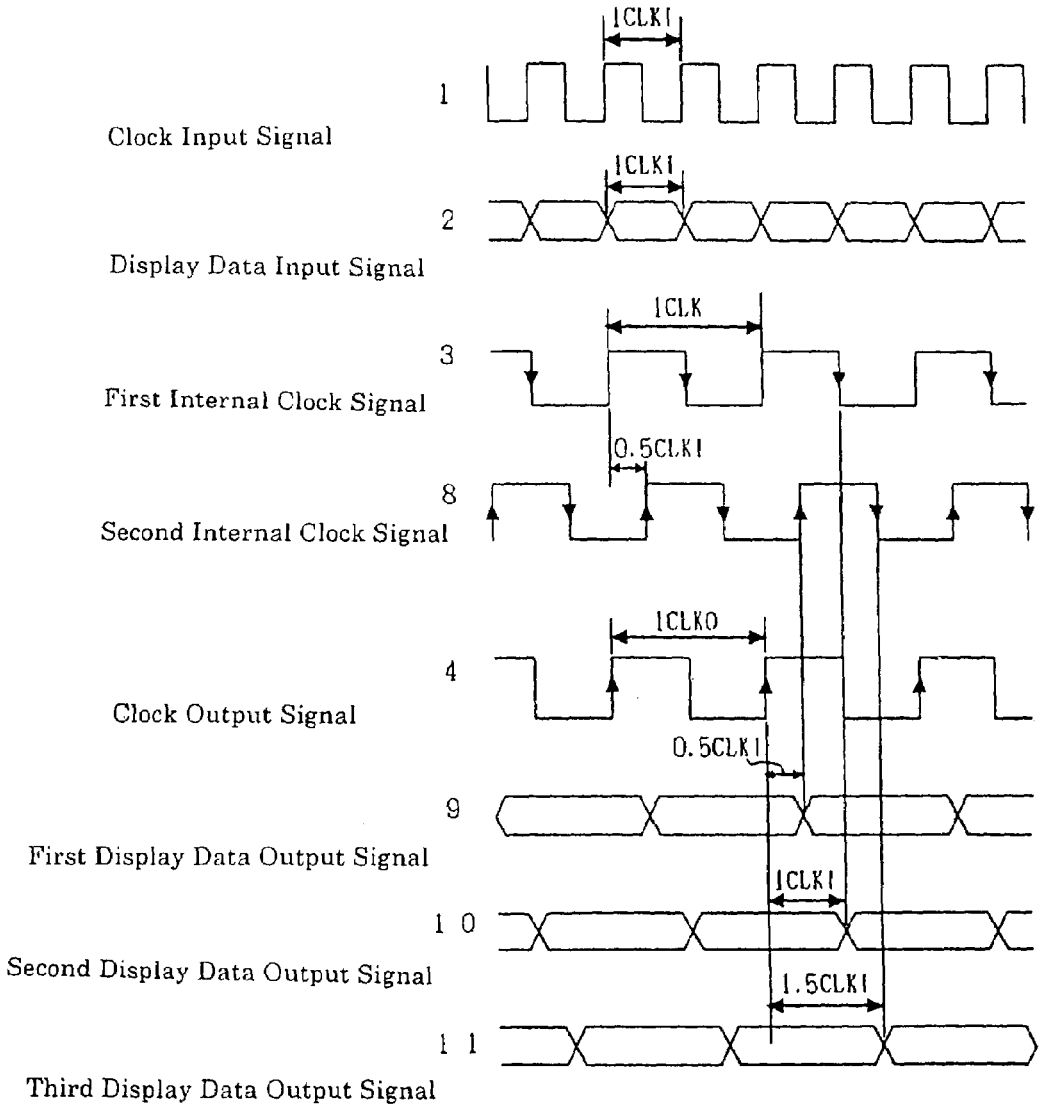
FIG. 1 is voltage waveform diagrams each showing a relation between input/output sections in an integrated circuit for generating 2-port display data output signals in the liquid crystal display according to Example 1 of the present invention.

FIG. 1 shows voltage waveform diagrams each showing a relation between the input/output sections in the integrated circuit for generating the 2-port display data output signals in the liquid crystal display according to Example 1 of the present invention. In the drawings, reference numeral 1 designates a clock input signal, numeral 2 designates a display data input signal, numeral 3 designates a first internal clock signal, numeral 4 designates a clock output signal, numeral 8 is a second internal clock signal delayed by a half period (for a period "H" or a period "L") of the clock input signal 1 with respect to the first internal clock signal 3, numeral 9 is a first display data output signal delayed by 0.5 period of the clock input signal 1 with respect to the active edge of the clock output signal 4 serving as an edge for latching in a source driver IC to which the display data signal is outputted, numeral 10 is a second display data output signal delayed by one period of the clock input signal 1 with respect to the active edge of the clock output signal 4 serving as an edge for latching in a source driver IC to which the display data signal is outputted, and numeral 11 is a third display data output signal delayed by 1.5 period of the clock input signal 1 with respect to the active edge of the clock output signal 4 serving as an edge for latching in a source driver IC to which the display data signal is outputted.

Period of the display data input signal 2 is same as the period 1CLKI of the clock input signal 1, and period of the display data output signal is same as the period 1CLK of the internal clock signal and the period 1CLKO of the clock output signal 4. 1CLK is an equivalent duration to 2CLKI, and 1CLKO is an equivalent duration to 2CLKI. Arrows of the internal clock signals 3, 8 indicate active edges (leading edge and trailing edge in the diagram) of the latch circuit immediately before the display data output section in the integrated circuit, and arrows of the clock output signal 4 indicate active edges (leading edge in the diagram) of the latch circuit immediately after the display data input section in the source driver IC to which the display data output signal is outputted.

For example, supposing that, in the input section, the clock input signal 1 is denominated CLKI, and the display data input signal 2 is denominated RI[1:m], GI[1:m] and BI[1:m], and that, in the output section, the clock output signal 4 is denominated CLKO, m is an optional integer, the first display data output signal 9 is denominated RO1[1:m] and RO2[1:m], the second display data output signal 10 is denominated GO1[1:m] and GO2[1:m], the third display data output signal 11 is denominated BO1[1:m] and BO2[1:m], and RO1[1:m] and RO2[1:m] are signals obtained by dividing RI[1:m] into two kinds of data, GO1[1:m] and GO2[1:m] are signals obtained by dividing GI[1:m] into two kinds of data, and BO1[1:m] and BO2[1:m] are signals obtained by dividing BI[1:m] into two kinds of data, the signals RO1[1:m] and RO2[1:m], GO1[1:m] and GO2[1:m], and BO1[1:m] and BO2[1:m] are generated so that they may change at three different points on the tame base.

That is, by dividing point of simultaneous change, in which the data output signals are changed with a delay by 0.5 period, 1 period and 1.5 period of the clock input signal with respect to the active edge (leading edge in this case) of the clock output signal, into three different points, number of simultaneous changes of the data output signals is reduced.

Figure 2:
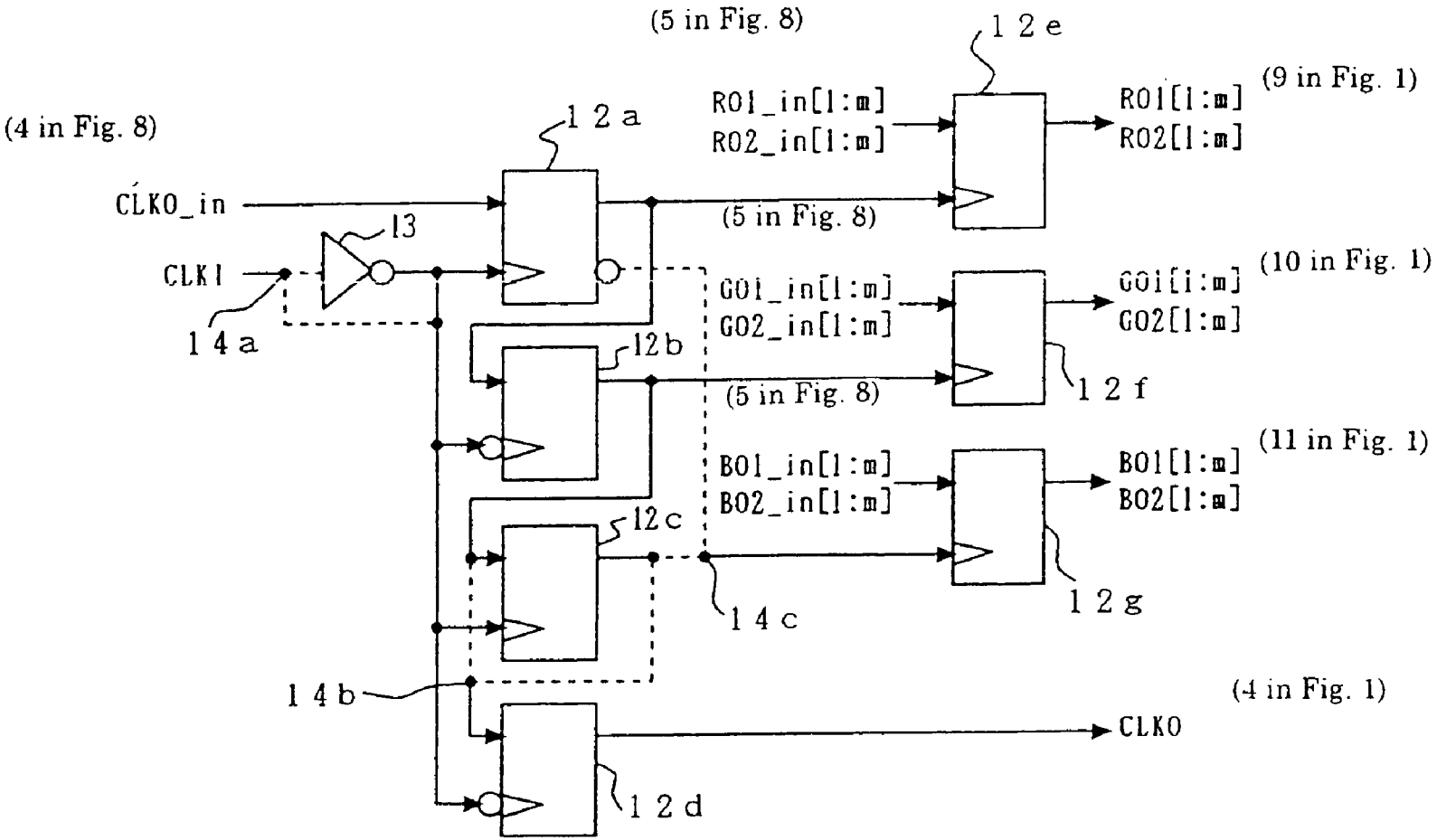
FIG. 2 is a circuit diagram of the integrated circuit for generating the display data output signals according to Example 1.
Figure 8:
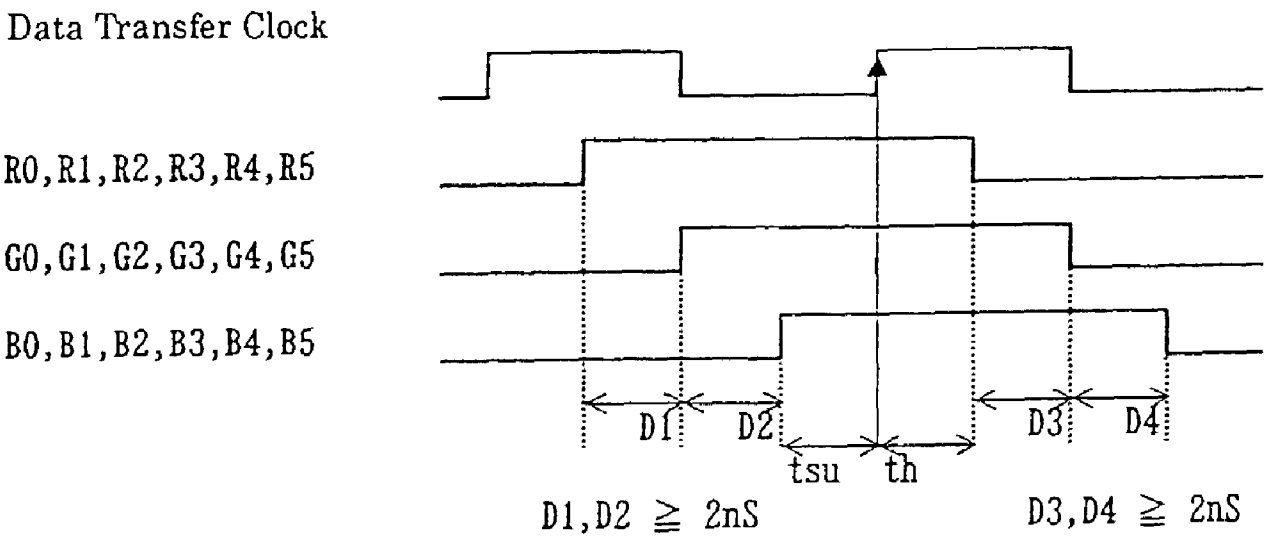
FIG. 8 is a diagram of the timing for changing the transfer display data according to Example 5 of the invention.

FIG. 2 is an example of circuit diagram for generating the output signals in FIG. 1, and in which reference numeral 12 designates a latch circuit, numeral 13 designates a NOT circuit, numeral 14 is a point for connecting either of two dot lines, clock signal CLKO-in of the input section is the clock output signal 4 in FIG. 8, the display data signals RO1-in [1:m], RO2-in[1:m], GO1-in[1:m], GO2-in[1:m], BO1-in[1:m] and BO2-in[1:m] are the display data output signals 5 in FIG. 8, and the clock signal CLKO, the display data output signals RO1[1:m] and RO2[1:m], GO1[1:m] and GO2[1:m], and BO1[1:m] and BO2[1:m] in the output section correspond to numerals 4, 9, 10 and 11 in FIG. 1, respectively.

Figure 3:
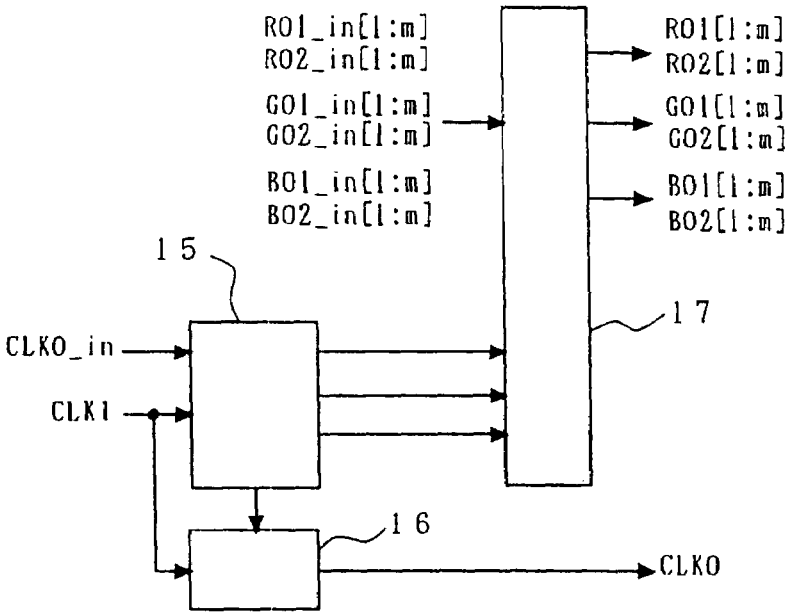
FIG. 3 is a block diagram of the function of the integrated circuit for generating the display data output signals according to Example 1.

FIG. 3 shows a circuit for generating the output signals in FIG. 1 for each function block, and in which reference numeral 15 designates an internal clock signal generating section, numeral 16 designates a clock output signal generating section, and numeral 17 designates a data latch section. Referring to FIG. 2, reference numerals 12*a*, 12*b*, 12*c* correspond to numeral 15 in FIG. 3, numeral 12*d* corresponds to numeral 16, and numerals 12*e*, 12*f*, 12*g* correspond to numeral 17. In FIG. 3, number of solid lines at RO1-in[1:m], RO2-in[1:m], GO1-in[1:m], GO2-in[ 1:m], BO1-in [1:m], BO2-in[1:m], RO1[1:m], RO2[1:m], GO1[1:m], GO2[1:m], BO1[1:m] and BO2[1:m]shows a total number of different points of change on the time base, and this drawing shows one point of change on the time base in the input section, and three different points of change on the time base in the output section.

In this Example 1, number of simultaneous changes of the display data output signals can be reduced to ⅓ at the maximum as compared with the conventional integrated circuit, and amount of change at each point with respect to a momentary current generated from the entire output buffer at the time of changing the data output signals of the data output section is reduced to about ⅓ as compared with the conventional integrated circuit, whereby it becomes possible to obtain a liquid crystal display of high quality in which electromagnetic wave noise in the input/output signal section and unnecessary electromagnetic interference (EMI) negatively affecting other system and circuit are reduced.

In the setting performed in FIG. 3, in case of dividing the point of change into plural different points of change with respect to the time base of the display data output signals RO1[1:m], RO2[1:m], GO1[1:m], GO2[1:m], BO1[1:m] and BO2[1:m], or changing the three points of change into only two different points of change, number of the simultaneous changes of the display data output signals is also reduced, and a ratio at the time with respect to a momentary current generated from the entire output buffer at the time of changing the data output signals of the data output section is reduced, whereby an advantage is performed such that electromagnetic wave noise in the input/output signal section and unnecessary electromagnetic interference negatively affecting other system and circuit due to the current are reduced.

Example 2

Figure 4:
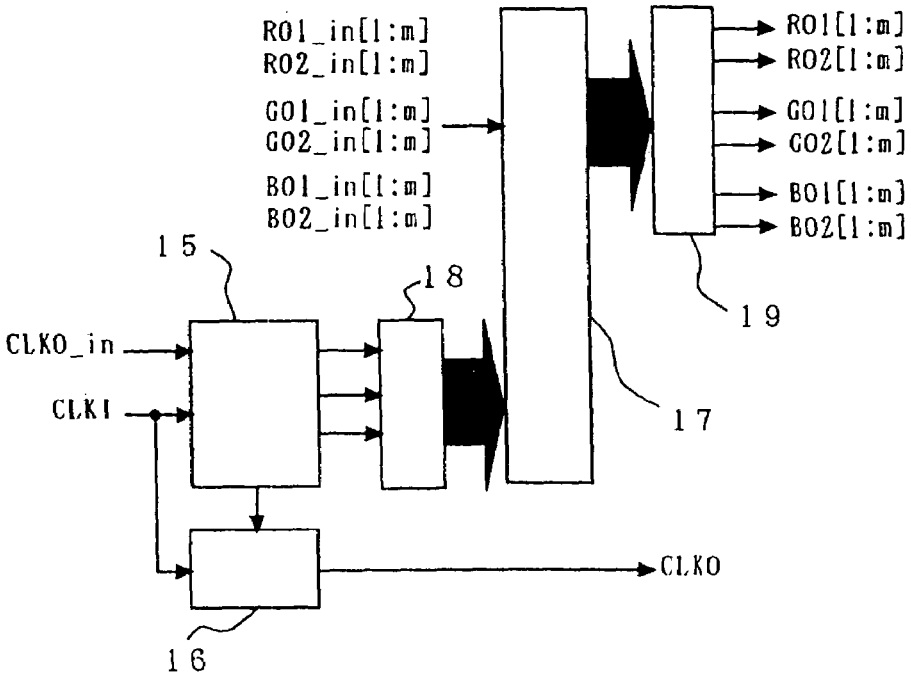
FIG. 4 is a block diagram of the function of the integrated circuit for generating the display data output signals according to Example 2.

FIG. 4 shows a circuit for generating output signals according to Example 2, and this is an example of circuit for each function block in which the function block in FIG. 3 is improved in such a manner that a delay circuit section for providing an appropriate delay during the period from input to output is added to either before or after the data latch section or to both before and after the data latch section. In the drawing, reference numeral 15 designates an internal clock signal generating section, numeral 16 designates a clock output signal generating section, numeral 17 is data latch section, numeral 18 is a first delay circuit section, and numeral 19 is a second delay circuit section.

Though it is shown in FIG. 4 that points of change of the display data output signals RO1[1:m], RO2[1:m], GO1[1:m], GO2[1:m], BO1[1:m] and BO2[1:m] obtained by the circuit in FIG. 3 with respect to the time base are divided into six different points of change which are twice as many as those of the circuit in FIG. 3, it is actually possible to increase the points of change to a value which is twice as many as number "m" of the display data output signals at the maximum.

In this Example 2, it is possible to reduce the number of simultaneous changes of the display data output signals by inverse number times as many as the conventional display data output signals at the maximum, and amount of change at each point with respect to the momentary current of the output buffer generated at the time of changing the display data output signals is reduced by about inverse number times as many as the conventional display data output signals at the maximum, whereby it becomes possible to obtain a liquid crystal display of high quality in which electromagnetic wave noise in the input/output sections and unnecessary electromagnetic interference negatively affecting other system and circuit are reduced.

In the setting performed in FIG. 4, in case of dividing the point of change into plural different points of change with respect to the time base of the display data output signals RO1[1:m], RO2[1:m], GO1[1:m], GO2[1:m], BO1[1:m] and BO2[1:m], or changing the six points of change into any optional number of points of change, number of the simultaneous changes of the display data output signals is also reduced, and a ratio at the time with respect to a momentary current of the entire output buffer generated at the time of changing the display data output signals is reduced, whereby an advantage is performed such that electromagnetic wave noise in the input/output signal section and unnecessary electromagnetic interference negatively affecting other system and circuit due to the current are reduced.

Example 3

Figure 5:
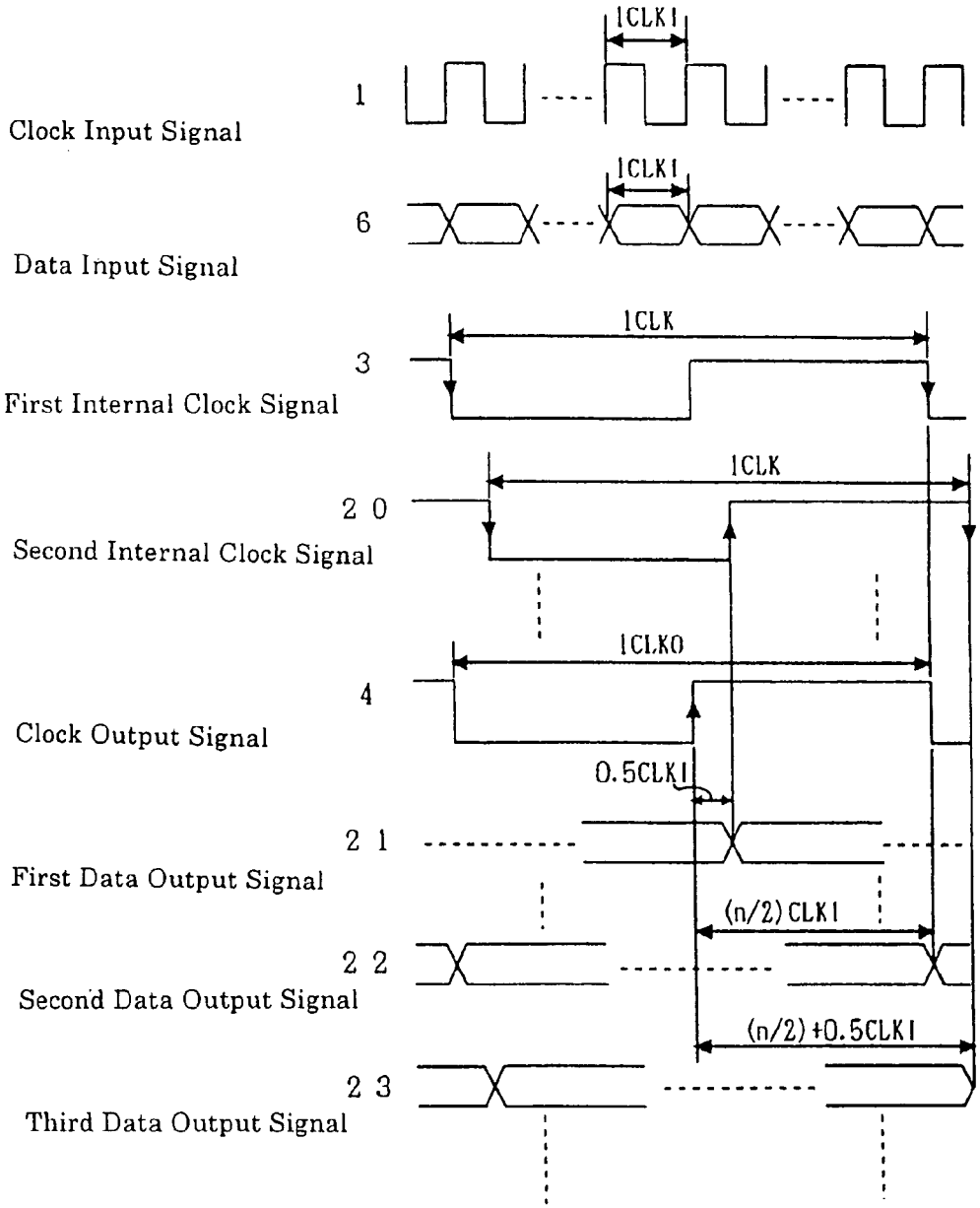
FIG. 5 is a block diagram of a relation between the input/output sections of the integrated circuit for generating the display data output signals according to Example 3.

FIG. 5 shows voltage waveform diagrams of a relation between the input/output signal sections in the integrated circuit for generating data output signals of multi-port (n ports: n is an integer) having two ports or more according to Example 3 of the invention. In the drawing, reference numeral 1 designates a clock input signal, numeral 3 designates a first internal clock signal serving as a reference, numeral 4 is a clock output signal, numeral 6 is a data input signal, numeral 20 is a second internal clock signal delayed by 0.5 period of the clock input signal 1 from the first internal clock signal 3, numeral 21 is a first data output signal delayed by 0.5 period of the clock input signal 1 from the active edge of the clock output signal 4, numeral 22 is a second data output signal delayed by (n/2) period of the clock input signal 1 from the active edge of the clock output signal 4, and numeral 23 is a third data output signal delayed by ((n/2)+0.5) period of the clock input signal 1 from the active edge of the clock output signal 4. Period of the data input signal 6 is same as the period 1CLKI of the clock input signal 1, and period of the data output signal is same as the period 1CLK of the internal clock signal 3 and the period 1CLKO of the clocks output signal 4. Duration of 1CLK is equivalent to the duration of nCLKI, and duration of 1CLKO is equivalent to the duration of nCLKI. Arrows of the edges of the internal clock signals indicate active edges (leading edge and trailing edge in the drawing) of the latch circuit immediately before the data output section in the integrated circuit, and arrows of the edges of the clock output signals indicate active edges (leading edge in the drawing) of the latch circuit immediately after the data input section to which data output signals are outputted. In this connection, the clock input signal 1 and the clock output signal 4 are not always set as input/output terminals.

In FIG. 5, a part of the internal clock signals delayed by integer times as long as a half period of the clock input signal 1 from the first internal clock signal 3 which is same as the second internal clock signal 20, and a part of the data output signals delayed by integer times as long as a half period of the clock input signal 1 from the active edge of the clock output signals 4 which are same as the data output signals 21, 22, 23 are omitted.

Supposing that, in the input section, the clock input signal 1 is denominated CLKI, m1, m2, . . . mn are optional integers, and the data input signal 6 is denominated DI(1)[1:m1], DI(2)[1:m2], . . . DI(n)[1:mn], and that, in the output section, the clock output signal 4 is denominated CLKO, the first data output signal 21 is denominated DO(1)[1:m1], the second data output signal 22 is denominated DO(n/2)[1:m(n/2)] and the third data output signal 23 is denominated DO(n+1)/2[1:m(n+1)/2], the signals DO(1)[1:m1], DI(2)[1:m2], . . . DI(n)[1:mn] are generated so that they may change at n different points on the tame base.

Figure 6:
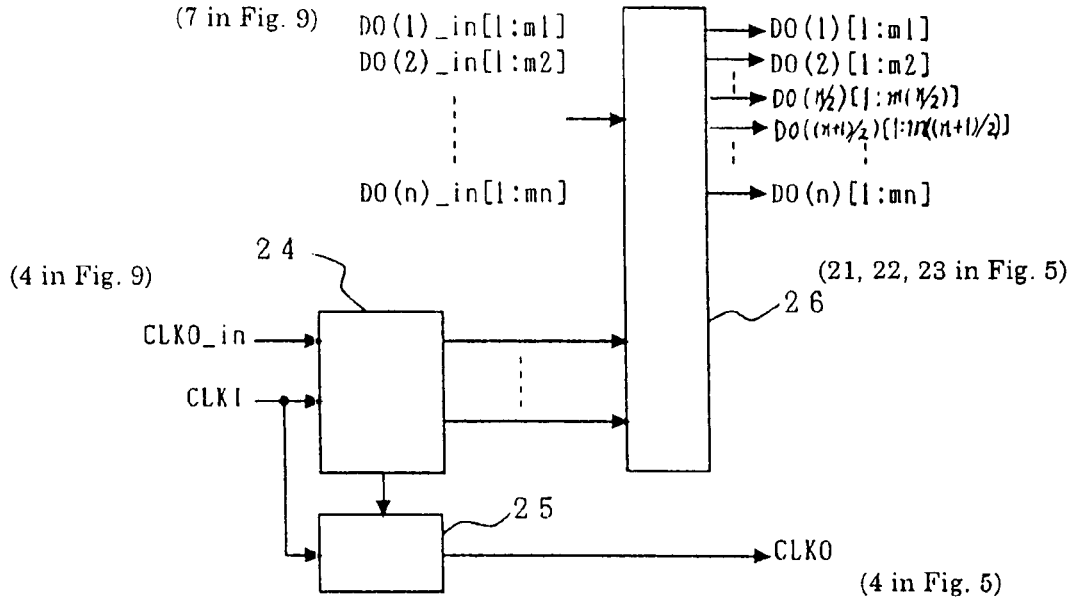
FIG. 6 is a block diagram of the function of the integrated circuit for generating the display data output signals according to Example 3.
Figure 9:
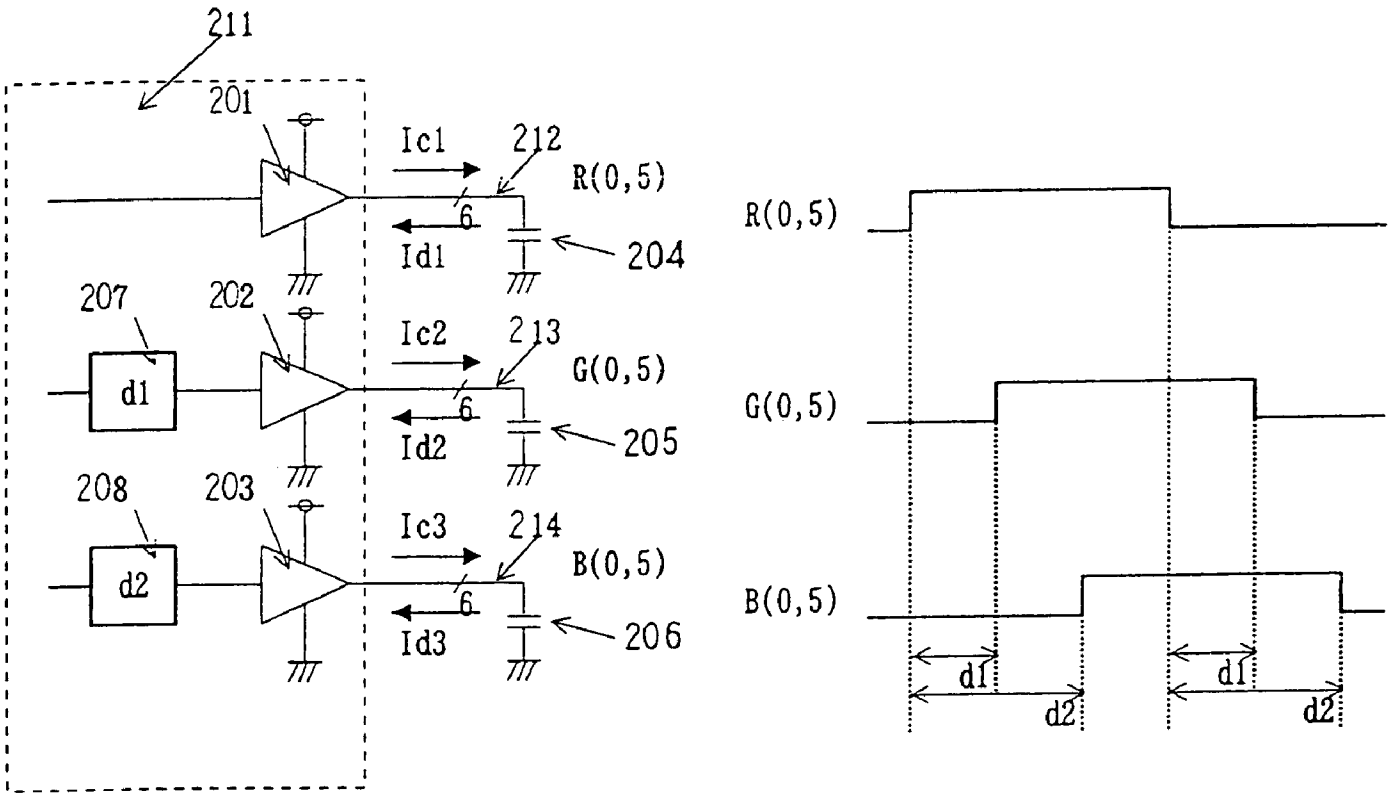
FIG. 9 shows an example of circuit to achieve the data transfer timing shown in FIG. 8.

FIG. 6 shows a circuit for generating the output signals in FIG. 5 for each function block, and in which reference numeral 24 designates an internal clock signal generating section, numeral 25 designates a clock output signal generating section, numeral 26 is a data latch section, a clock signal CLKO-in of the input section corresponds to the clock signal 4 in FIG. 9, data signals DO(1)-in[1:m1], DI(2)-in[1:m2], . . . DI(n)-in[ 1:mn] correspond to the data output signal 7 in FIG. 9, and data signals DO(1)[1:m1], DO(n/2)[1:m(n/2)] and DO(n+1)/2[ 1:m(n+1)/2] respectively correspond to reference numerals 4, 21, 22 and 23 in FIG. 5.

In this Example 3, it is possible to reduce the number of simultaneous changes of the display data output signals by inverse number times of a value obtained by adding 1 to the conventional number of output ports at the maximum, and amount of change at each point with respect to the momentary current of the output buffer generated at the time of changing the display data output signals is reduced by about inverse number times of a value obtained by adding 1 to the conventional number of ports at the maximum, whereby it becomes possible to obtain a liquid crystal display of high quality in which electromagnetic wave noise in the input/output sections and unnecessary electromagnetic interference negatively affecting other system and circuit are reduced.

In the setting performed in FIG. 6, in case of dividing the point of change into plural different points of change with respect to the time base of the display data output signals DO(1)[1:m1], DI(2)[1:m2], . . . DI(n)[1:mn], or changing the six points of change into any plural points of change, number of the simultaneous changes of the display data output signals is also reduced, and amount of change at each point with respect to a momentary current of the entire output buffer generated at the time of changing the display data output signals is reduced, whereby an advantage is performed such that electromagnetic wave noise in the input/output signal section and unnecessary electromagnetic interference negatively affecting other system and circuit due to the current are reduced.

Figure 7:
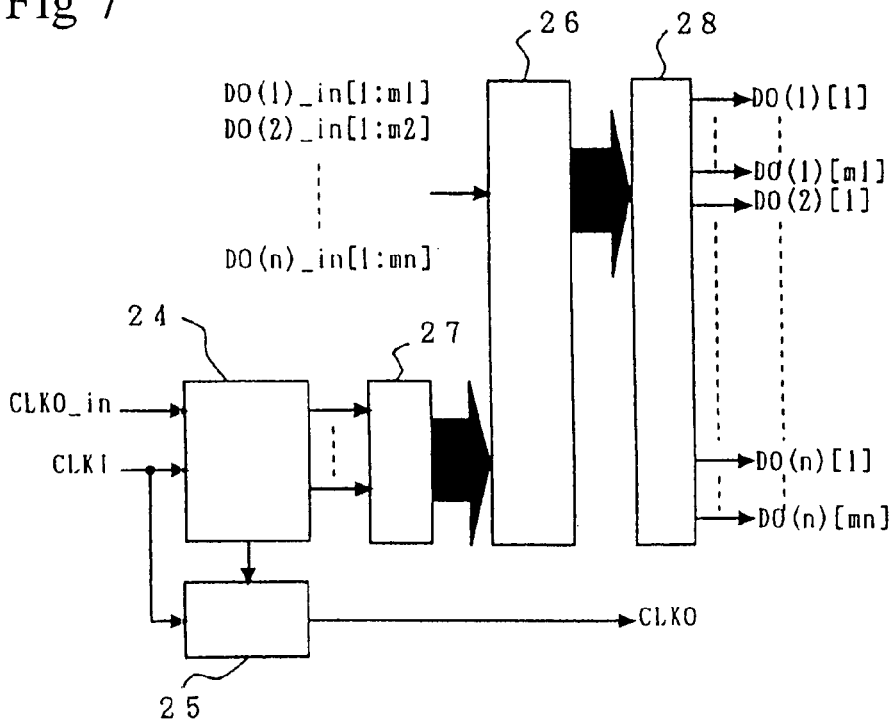
FIG. 7 is a block diagram of the function of the integrated circuit for generating the display data output signals according to Example 4.

FIG. 7 shows a circuit for generating output signals according to Example 4, and this is an example of circuit for each function block in which the function block in FIG. 6 is improved in such a manner that a delay circuit section for providing an appropriate delay during the period from input to output is added to either before or after the data latch section or to both before and after the data latch section. In the drawing, reference numeral 24 designates an internal clock signal generating section, numeral 25 designates a clock output signal generating section, numeral 26 is data latch section, numeral 27 is a first delay circuit section, and numeral 28 is a second delay circuit section.

Though it is shown in FIG. 7 that points of change of the display data output signals DO(1)[1:m1], DI(2)[1:m2], . . . DI(n)[1:mn] obtained by the circuit in FIG. 6 with respect to the time base are ((n+m1+m2+ . . . +nm)/n) times, that is, they are divided into m1+m2+ . . . +nm (number of data output signals) different points of change, it is actually shown that in this case it is possible to increase the points of change on the time base to an inverse number times as many as the display data output signals at the maximum.

In this Example 4, it is possible to reduce the number of simultaneous changes of the display data output signals by inverse number times as many as the conventional display data output signals at the maximum, and amount of change at each point with respect to the momentary current of the output buffer generated at the time of changing the display data output signals is reduced by about inverse number times as many as the conventional display data output signals at the maximum, whereby it becomes possible to obtain a liquid crystal display of high quality in which electromagnetic wave noise in the input/output sections and unnecessary electromagnetic interference negatively affecting other system and circuit due to the current are reduced.

In the setting performed in FIG. 7, in case of dividing the point of change into plural different points of change with respect to the time base of the data output signals DO(1)[1:m1], DI(2)[1:m2], . . . DI(n)[1:mn], or changing the six points of change into any optional number of points of change, number of the simultaneous changes of the data output signals is also reduced, and amount of change at each point with respect to a momentary current of the entire output buffer generated at the time of changing the display data output signals is reduced, whereby an advantage is performed such that electromagnetic wave noise in the input/output signal section and unnecessary electromagnetic interference negatively affecting other system and circuit due to the current are reduced.

Example 5

Example 5 according to the invention is hereinafter described. FIG. 8 is a chart of the timing for changing the transfer display data according to Example 5. In FIG. 8, when RGB data are changed from L to H, timing for changing the G data buses (G0, G1, G2, G3, G4, G5) is delayed by D1 from the R data buses (R0, R1, R2, R3, R4, R5), and timing for changing the B data buses (B0, B1, B2, B3, B4, B5) is further delayed by D2 from the G data buses.

When the RGB data are changed from H to L, timing for changing the G data buses is delayed by D3, and timing for changing the B data buses is further delayed by D4.

In this respect, as to the delays D1 to D4, it is also preferred that D1=D3, D2=D4 or D1=D2=D3=D4.

FIG. 9 shows an example of circuit to achieve the data transfer timing shown in FIG. 8.

Figure 26:
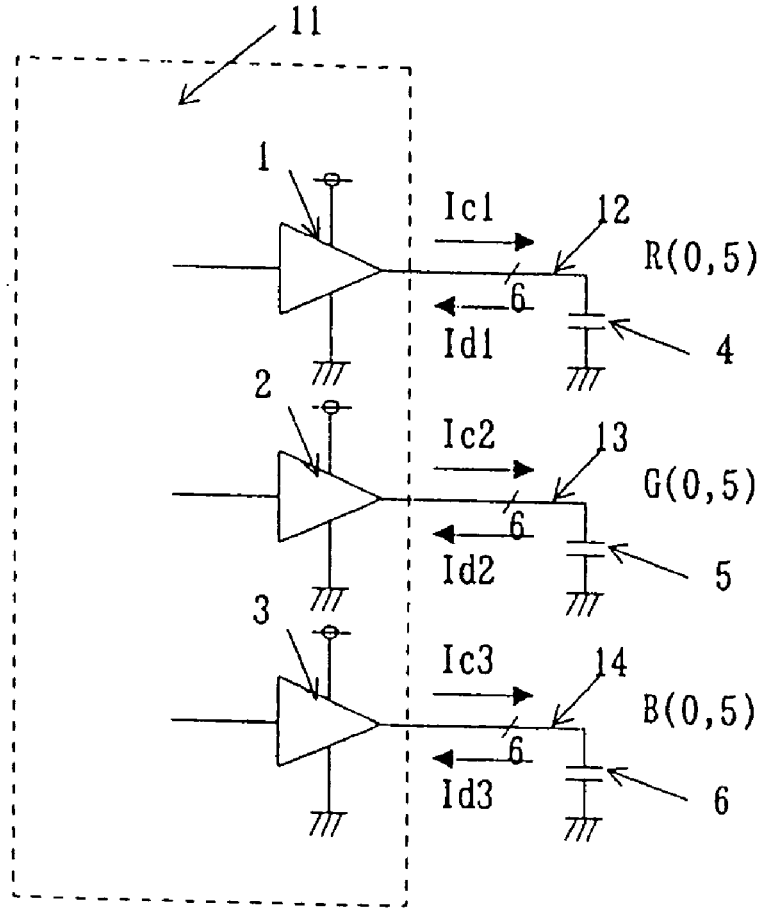
FIG. 26 is a diagram showing an equivalent circuit according to an example of the prior art.
Figure 27:
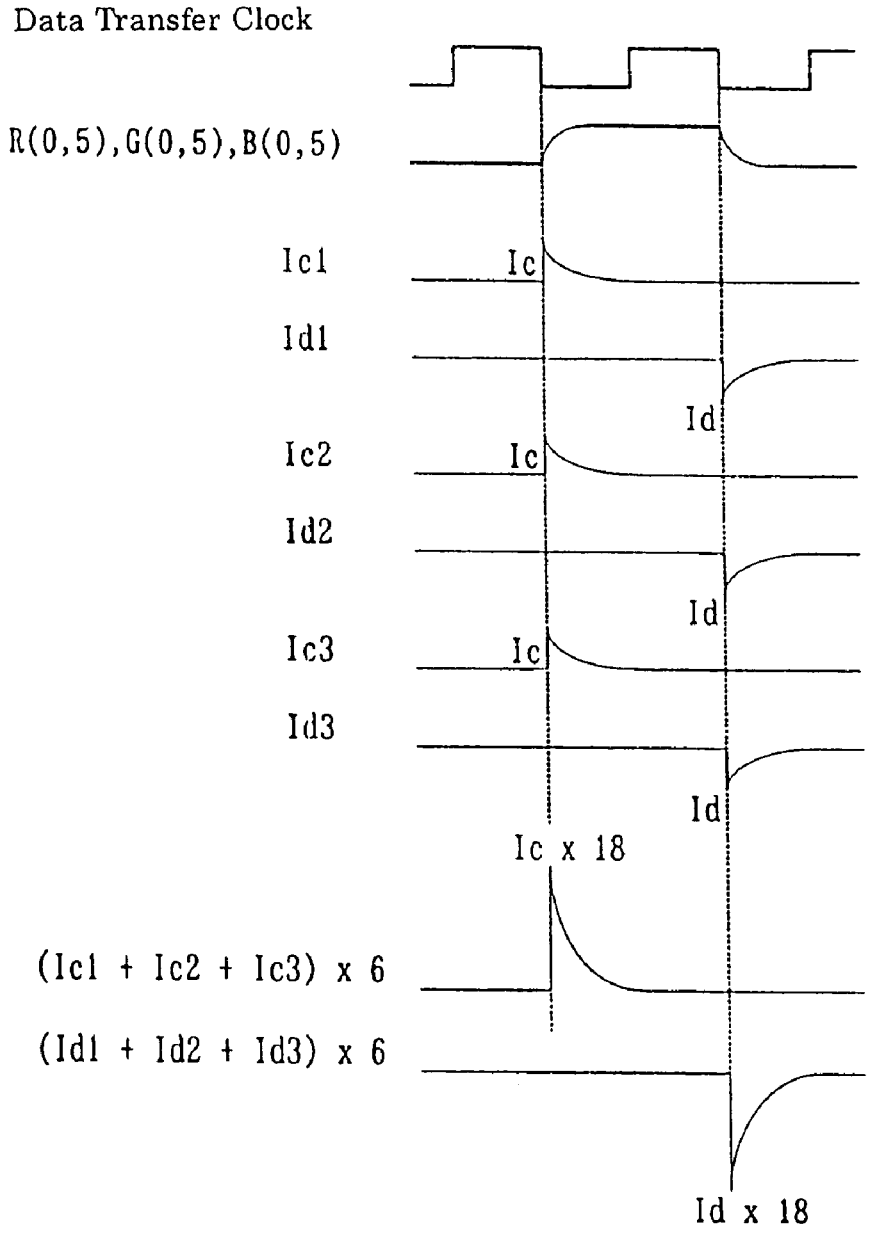
FIG. 27 is a diagram to explain the example according to the prior art.
Figure 28:
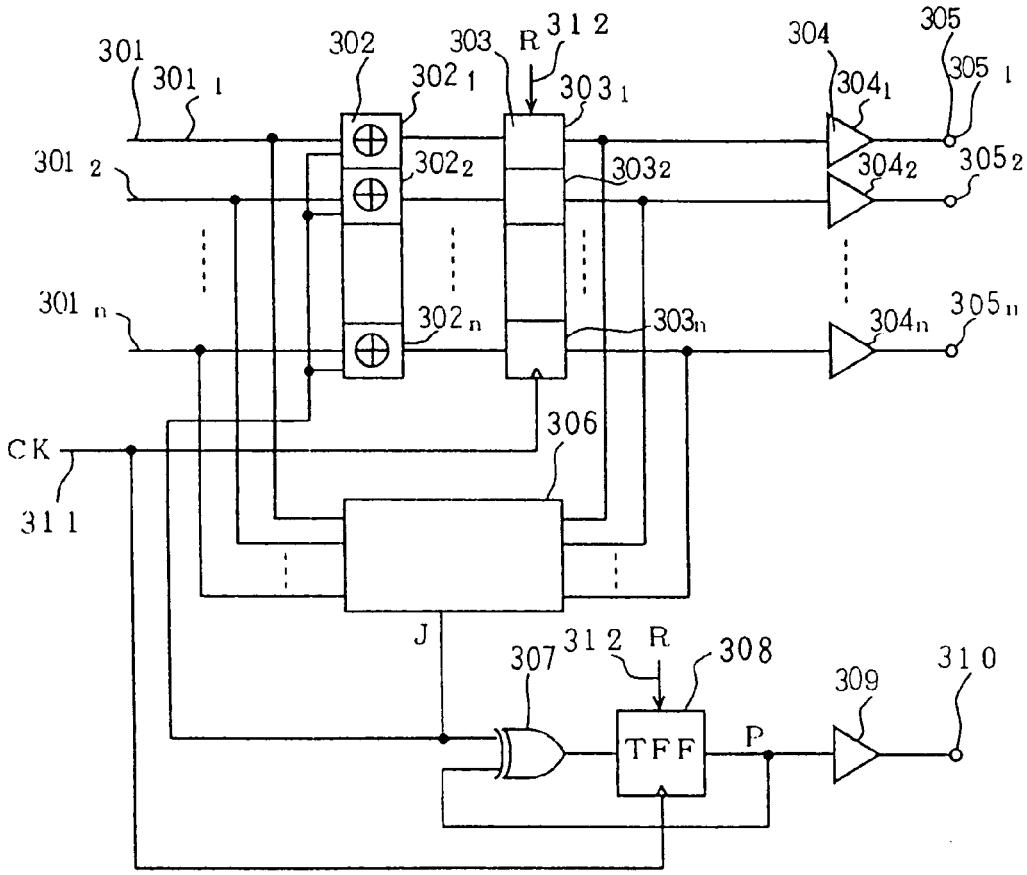
FIG. 28 is a block diagram showing the delivery of signal between the dedicated IC and the source driver IC of a liquid crystal display according to the prior art.

FIG. 9 shows that, in the conventional circuit shown in FIG. 26, a delay circuit 207 having a delay time d1 is inserted in the G data output circuit, and a delay circuit 208 having a delay time d2 is inserted in the B data output circuit. In FIG. 9, same reference numerals are designated to the same parts as those of the conventional circuit in FIG. 26, and further description is omitted herein.

In this arrangement, by setting to be d1=D1 and d2=D1+D2, the timing shown in FIG. 8 is achieved.

Note that in the example shown in FIG. 9, D1=D3 and D2=D4 referring to FIG. 8.

Figure 10:
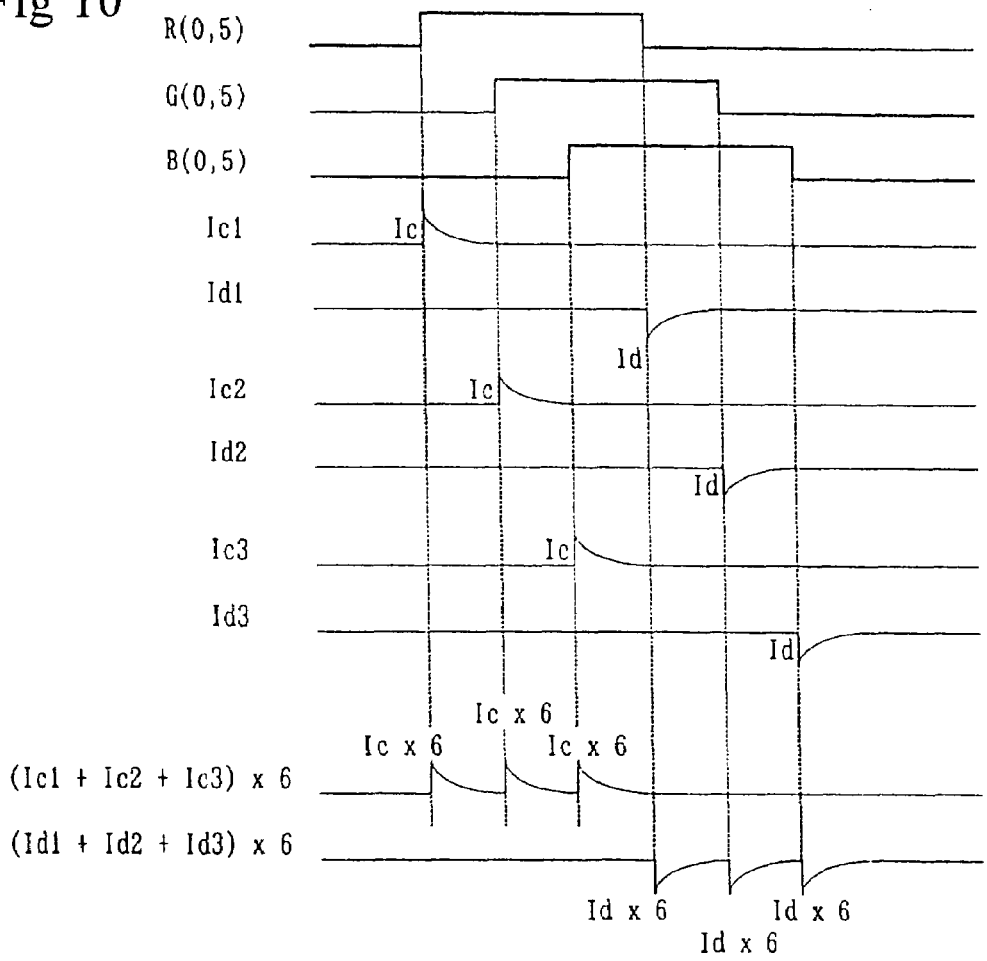
FIG. 10 is a diagram to explain the data transfer timing shown in FIG. 8.

FIG. 10 shows voltage waveforms and current waveforms of respective RGB data buses 212, 213, 214 when RGB data in FIG. 9 are transferred.

In the change of each RGB data to L, H, L, when data are changed from L to H in the same manner as shown in FIG. 17 described with reference to the conventional circuit, the currents Ic1, Ic2, Ic3 for charging the load capacities 204, 205, 206 flow to each data bus, and when the data are changed from H to L, the currents Id1, Id2, Id3 for discharging the load capacities flow to respective data buses.

As these currents flow to the power source and to GND through the output circuit of the LCD timing controller IC 211 in the same manner as the conventional circuit, after all, a sum of these currents flows to the power source line inside and outside of the LCD timing controller IC 211 and to the GND line.

However, as there are time lags D1, D2 respectively in the timing for changing each RGB data bus as shown in FIG. 9, even when 18 bits in total are simultaneously changed, the currents Ic1, Ic2, Ic3 and Id1, Id2, Id3 flow with the time lags D1, D2. Accordingly, though a large current being 18 times as much as the current flowing in one output circuit flows at the time of changing the RGB data from L to H in the conventional circuit, a current as much as 6 bits forming each data bus, i.e., a current only 6 times as much as the current flowing in one output circuit flows in the example shown FIG. 9.

That is, as the maximum value of the current flowing simultaneously is reduced to ⅓ as compared with the conventional circuit, electromagnetic field noise due to such a current is also reduced to ⅓ as compared with the conventional circuit.

Though the changes of G data bus and B data bus are delayed from the R data bus in this example, the same advantage can be achieved by delaying other data bus from the G data bus or B data bus.

Example 6

Figure 11:
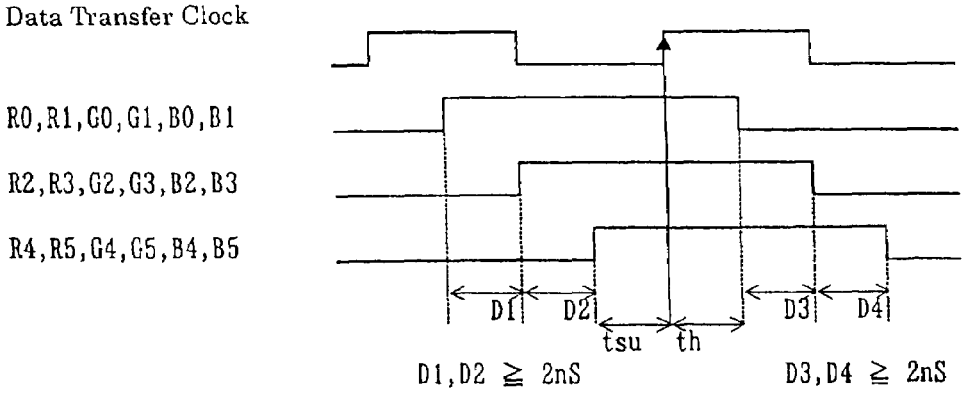
FIG. 11 is a chart of the timing for changing the transfer display data according to Example 6 of the invention.

FIG. 11 is a chart of the timing for changing the transfer display data according to Example 6 of the invention.

In FIG. 11, when RGB data are changed from L to H, R0. R1 among the R data buses, G0. G1 among the G data buses and B0, B1 among the B data buses are simultaneously changed, and R2, R3 among the R data buses, G2. G3 among the G data buses and B2, B3 among the B data buses are simultaneously changed with their timing for change delayed by D1. Further, the remaining data bits R4, R5, G4, G5, B4, B5 are simultaneously changed with their timing for change delayed by D2.

When the RGB data are changed from H to L, R2, R3, G2, G3, B2, B3 are changed with their timing for change delayed by D3 from R0, R1, G0, G1, B0, B1, and R4, R5, G4, G5, B4, B5 are changed with a further delayed by D4.

In this respect, as to the delays D1 to D4, it is also preferred that D1=D3, D2=D4 or D1=D2=D3=D4.

This Example 6 is an improvement of Example 5, and is hereinafter described in detail.

FIG. 12 shows an example in which a letter "H" is displayed on the TFT-LCD panel, and the letter "H" begins to be displayed from a picture element located at (n+1)th row and (m+5)th line (train) on the TFT-LCD panel filled with the picture elements each composed of one liquid crystal cell of red (R), green (G), blue (B). Thickness of the letter is formed of two picture elements.

Figure 14:
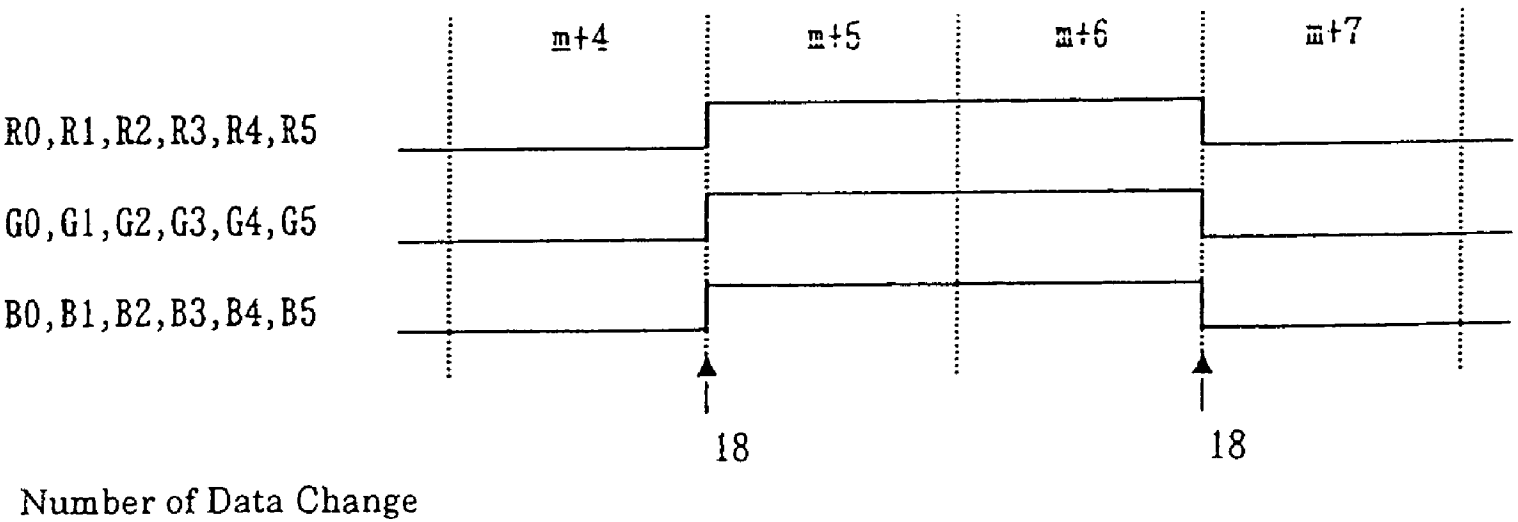
FIG. 14 is a diagram to explain the Example 6.
Figure 15:
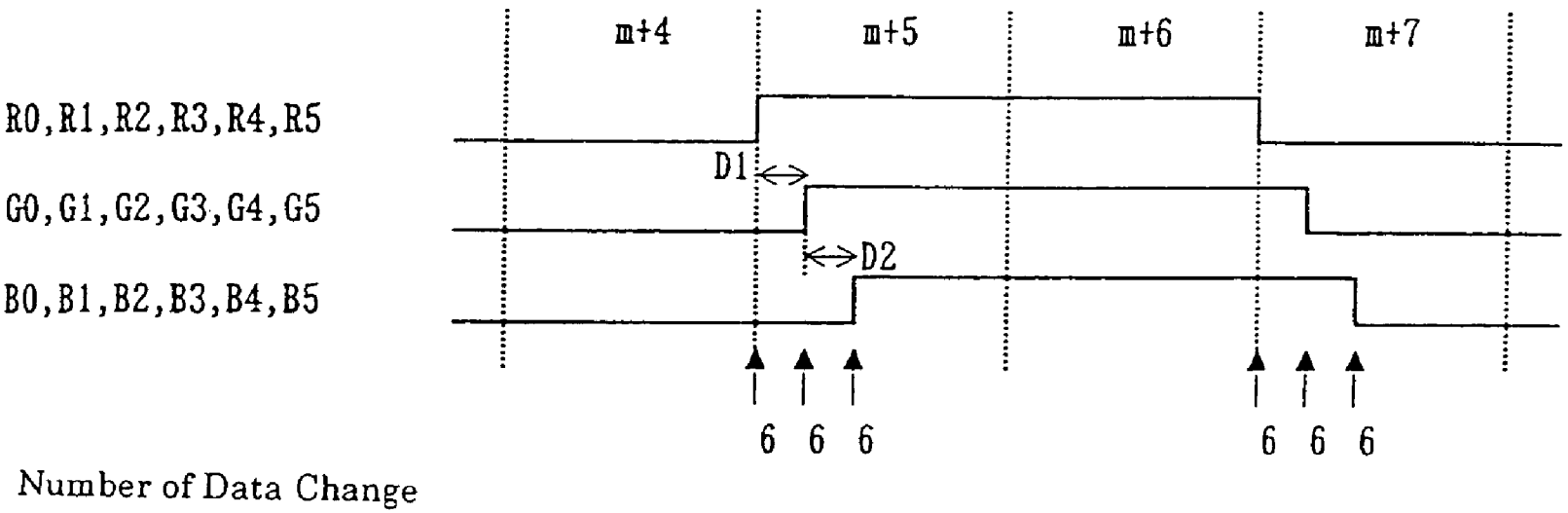
FIG. 15 is a diagram to explain the Example 6.

FIG. 13 shows enlargedly the region in and around the picture element located at (n+1)th row and (m+5)th line (train) in FIG. 12 (i.e., portion surrounded by the solid line in FIG. 12). Supposing that logical level of the data for displaying the picture element located at (n+1)th row and (m+4)th line (train) is L and that logical level of the data for displaying the (m+5)th and (m+6)th lines (trains) is H, the data of the (m+4)th and (m+5)th lines (trains) are changed as shown in FIG. 14 in the display data transfer, if the display data transfer is performed in the conventional manner. That is, 18 bits are simultaneously changed in the number of change of data from the data of (m+4)th line (train) to the data of (m+5)th line (train), and likewise 18 bits are simultaneously changed in the number of change of data from the data of (m+6)th line (train) to the data of (m+7)th line (train). On the other hand, number of change of data according to Example 5 of the invention is shown in FIG. 15.

In Example 5, as the data are changed so that the RGB data buses have time lags D1, D2, respectively, number of data changing simultaneously with the change from the data of (m+4) th line (train) to the data of (m+5) th line (train) is 6 bits, which is reduced to ⅓ as compared with the conventional method. In the same manner, number of data changing simultaneously with the change from the data of (m+6)th line (train) to the data of (m+7)th line (train) is only 6 bits.

Figure 16:
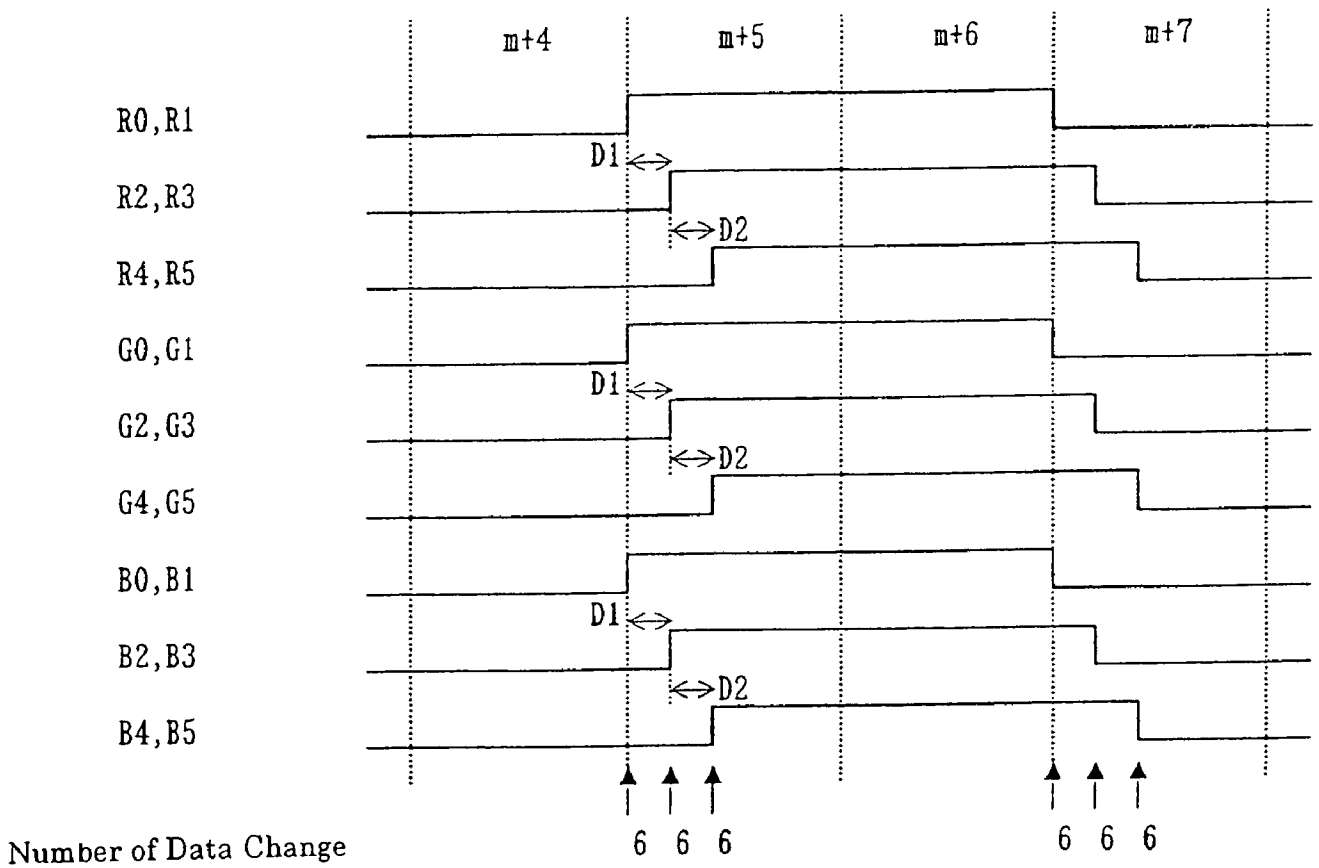
FIG. 16 is a diagram to explain the Example 6.

FIG. 16 shows what the number of change of data at the time of data transfer becomes in Example 6.

It is understood that, in Example 6, the maximum number of change of data is also 6 bits as shown in the drawing, which is reduced to ⅓ as compared with the conventional method, and the same advantage as Example 1 can be performed. That is, when carrying out the data transfer so that all 18 bits of RGB data are simultaneously changed, the disperse of changes of current flowing through the data buses shown in FIG. 10 according to Example 1 of the invention is achieved also in Example 6, whereby electromagnetic field noise is reduced as a matter of course.

Then, it is supposed that the letter "H" is formed by each of the picture elements arranged in order of G, B, R, as shown in FIG. 17, instead of those arranged in order of R, G, B, and displayed on the LCD panel.

In this case, data are changed from L to H not from (m+4)th line (train) to (m+5)th line (train) but from (m+5)th line (train) to (m+6)th line (train) in the R data bus.

Figure 18:
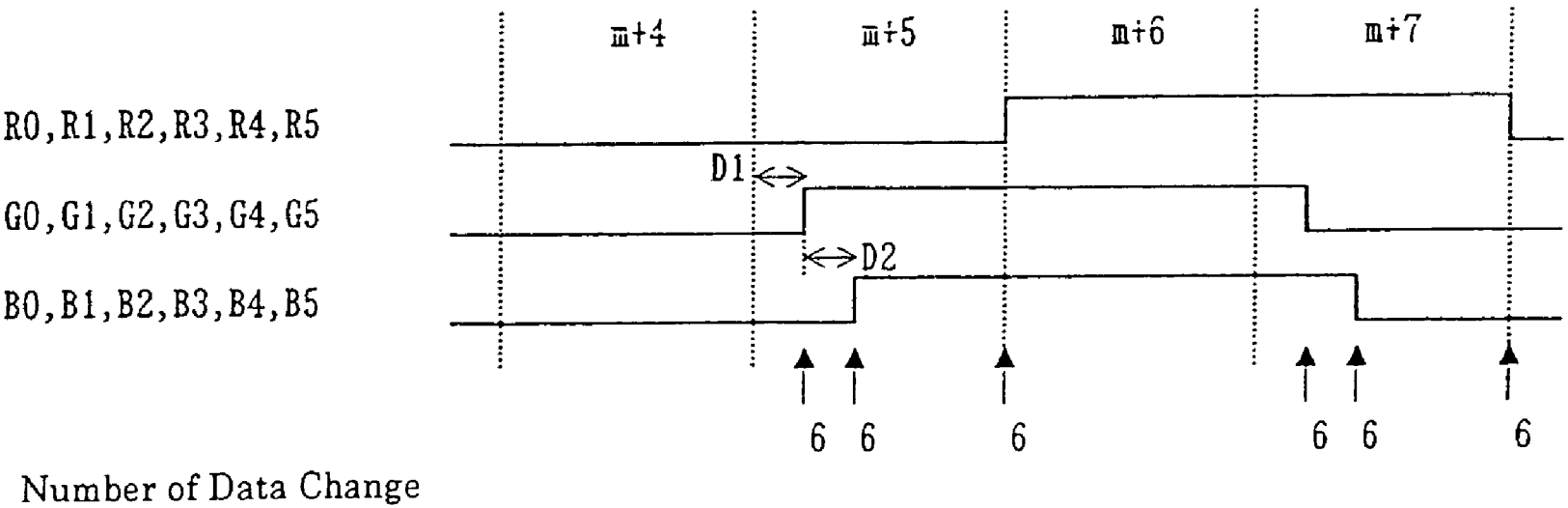
FIG. 18 is a diagram to explain the Example 6.
Figure 19:
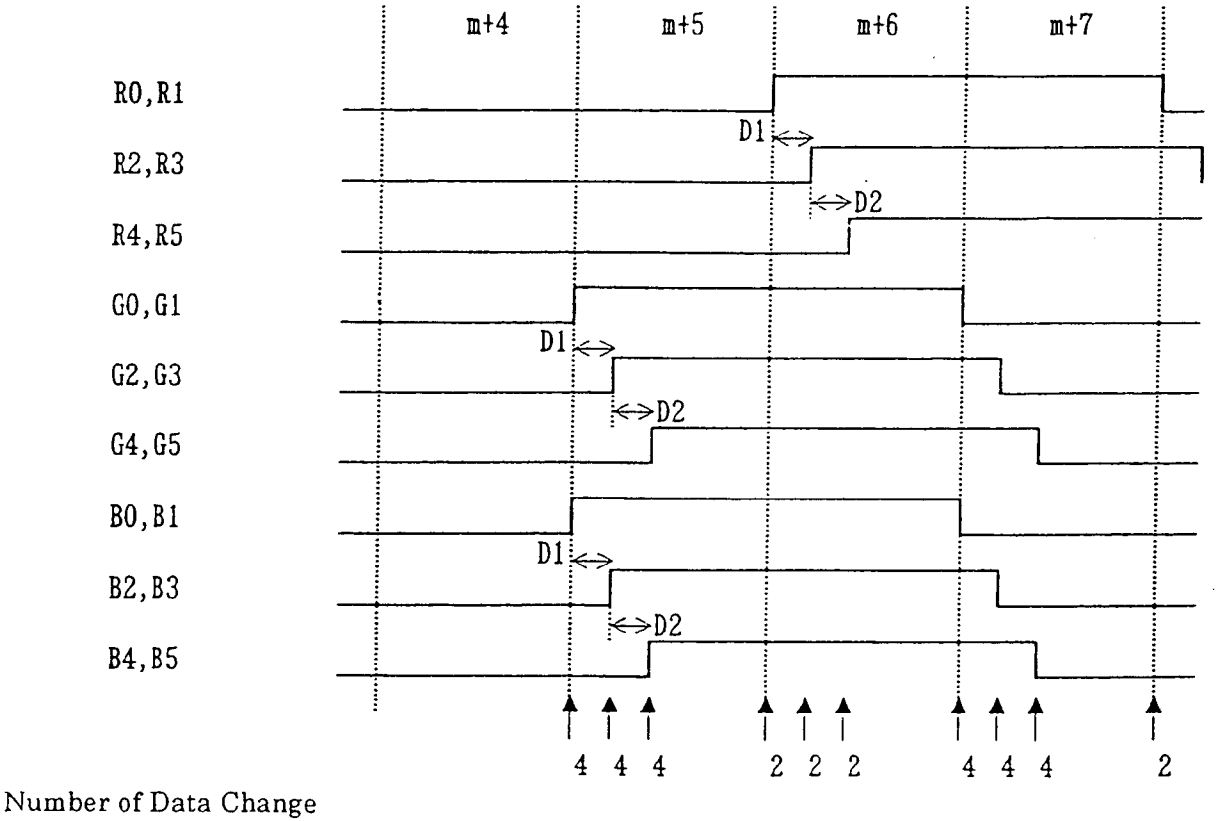
FIG. 19 is a diagram to explain the Example 6.

At this time, number of change of data in Example 5 is 6 bits at every timing as shown in FIG. 18. On the other hand, in this Example 6, the maximum number of change of data is 4 bits as shown in FIG. 19.

In other words, the maximum number of change is further reduced by 2 bits as compared with Example 5, and it is a matter of course that the electromagnetic field noise is further reduced as compared with Example 5.

As described above, in case of reducing electromagnetic field noise by dispersing a charge and discharge current of load capacity flowing through the output circuit of the LCD timing controller IC and the data bus by setting a time lag in the change of RGB display data, the electromagnetic field noise can be reduced more by dividing the RGB data duration into plural parts and setting a time lag between one part and another than by causing the timing of change to have a time lag between one RGB data bus and another.

Example 7

Though an example in which RGB display data are formed of 6 bits is shown respectively in Examples 5 and 6, it is also preferable that the display data are formed of 8 bits.

Figure 20:
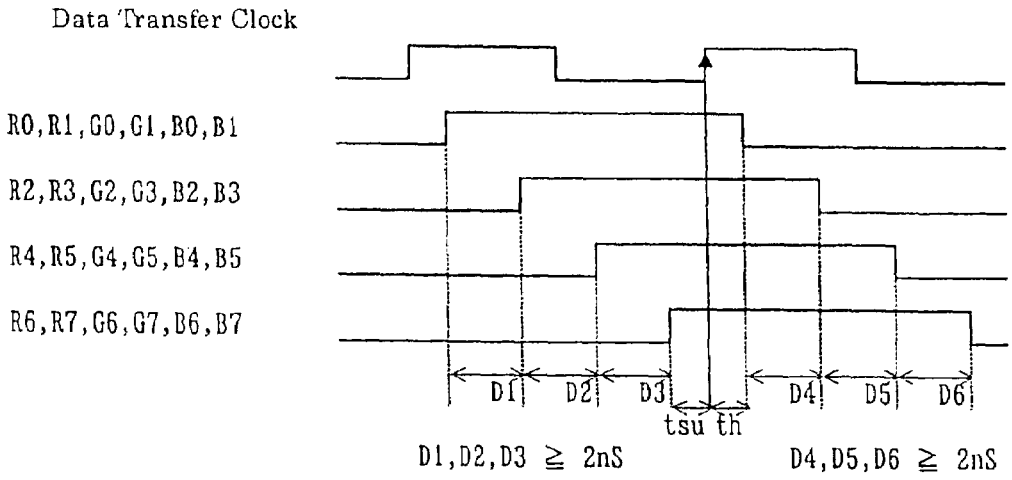
FIG. 20 is a chart of the timing for changing the transfer display data according to Example 7 of the invention.

FIG. 20 is a chart of the timing of changing the transfer display data formed of 8 bits showing Example 7.

Then, amount of time lags D1, D2, . . . in case of delaying the timing for changing the display data is decided. As shown in FIG. 10, in case of using a delay circuit for delaying the timing for changing the data, when amount of delay is large, circuit scale of the delay circuit is enlarged, and circuit scale of the LCD timing controller IC is also enlarged, which eventually results in a disadvantage of increasing cost and power consumption.

On the other hand, it is required that the amount of time lag is as small as possible so as not to sample any erroneous data in the sampling of RGB data of the LCD source driver IC 215.

The current data setup time and data hold time of the ordinary LCD source driver IC 215 are both 4 to 6 nS. Clock period of data transfer is about 25 nS in SVGA.

Accordingly, the time allowed for adjusting the timing of RGB data is 17 nS obtained by subtracting data setup time 4 nS, for example, and data hold time 4 nS, for example, from 25 nS of clock period.

That is, when the timing for changing RGB data is divided into three timings of RGB, maximum allowable value of each time lag D1, D2 is 17÷2=8.5 nS. In case of XGA, data transfer clock frequency is about 65 MHz and period is about 15.4 nS. When the timing for changing RGB data is divided into three timings of RGB, maximum allowable value of each time lag D1, D2 is 3.7 nS which is a half of 7.4 nS remaining after subtracting 8 nS which is a total of setup time and hold time of the source driver. In case of SXGA, data transfer clock frequency becomes higher, but generally the frequency is lowered by arranging the buses of RGB data in dual port, and therefore 6.5 MHz which is the transfer frequency used in case of XGA is maximum frequency actually used.

Figure 24:
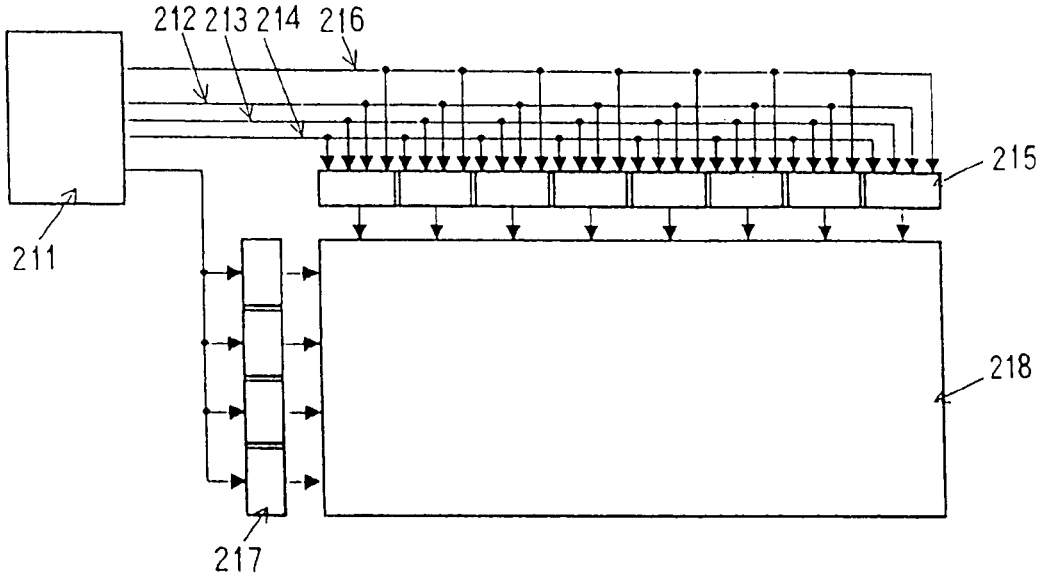
FIG. 24 is a block diagram showing the drive circuit of the TFT-LCD panel.
Figure 25:
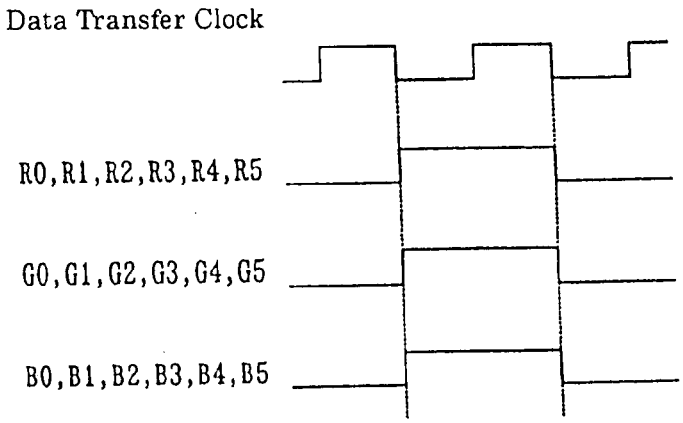
FIG. 25 is a diagram of the timing for changing the transfer display data according to the prior art.

On the other hand, in the TFT-LCD panel as shown in FIG. 24, the data bus line between the LCD timing controller IC 211 and the LCD source driver IC 215 is generally arranged on a printed wiring board.

To avoid a strain of signal line for data, clock, etc., an impedance matching is performed. In the printed wiring board popularly used, an impedance thereof is set to about 50 Ω and, therefore, the output impedance of the LVD timing controller IC 211 is also set to about 50 Ω.

The source driver IC 215 is generally manufactured by CMOS process, and input capacity thereof is in the range of about 4 to 6 pF, and when calculating a time constant from these values, 50 Ω×4 pF=2 nS. Comparing the time 2 nS obtained from the impedance of the data line with the maximum allowable timing regulation time 3.7 nS, there still remains a difference of 1.7 nS. However, it is desirable to consider this 1.7 nS as a margin and that minimum value of each time lag D1, D2 to be given to the timing for changing the RBG data is 2 nS.

Consequently, in the drive method of the liquid crystal display according to the invention, for the purpose of reducing unnecessary radiation noise due to the change of RGB data, when the transfer is performed by setting a time lag little by little to the timing for changing data, it is proposed that each time lag is set to be 2 nS or longer.

Example 8

Figure 21:
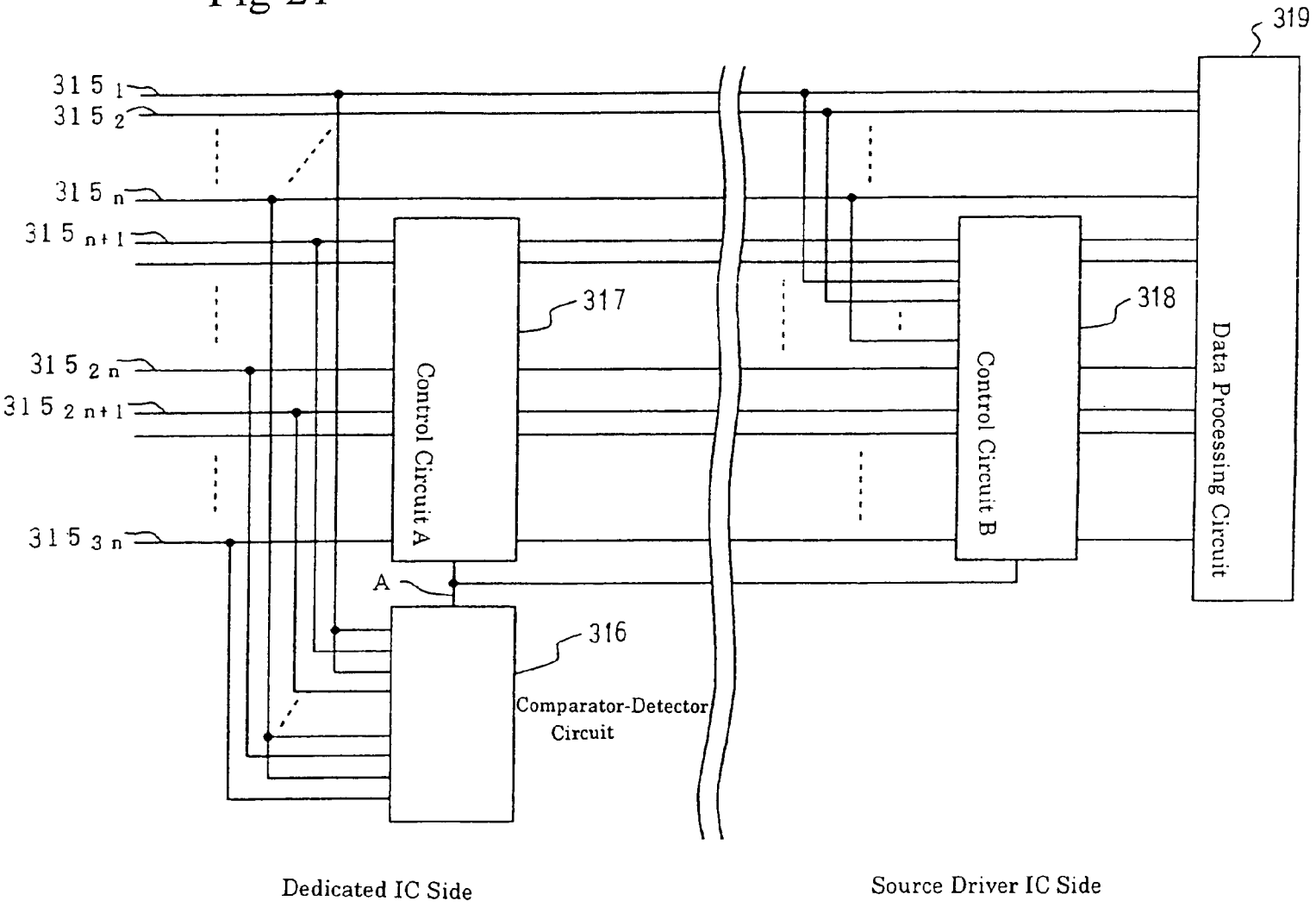
FIG. 21 is a block diagram showing Example 8 of the invention.
Figure 22:
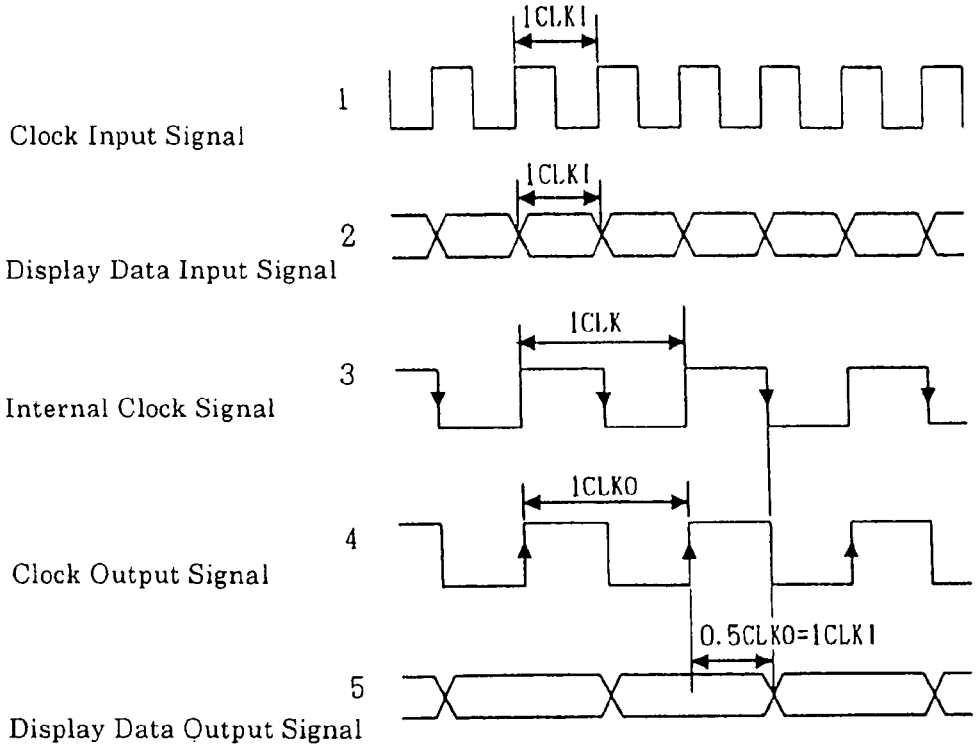
FIG. 22 is voltage waveform diagrams each showing a relation between the input/output sections in the integrated circuit for generating the 2-port display data output signals in the liquid crystal display according to the prior art.
Figure 23:
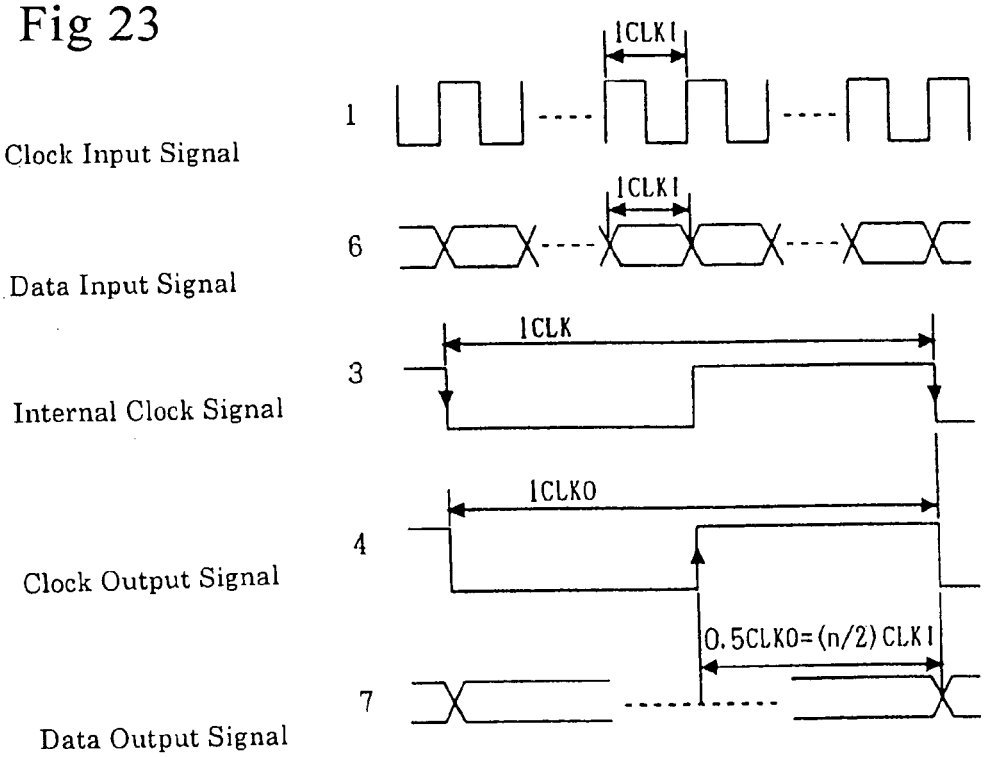
FIG. 23 shows voltage waveform diagrams each showing a relation between the input/output sections in the integrated circuit for generating the multi-port data output signals according to the prior art.

FIG. 21 is a block diagram showing a data delivery of the liquid crystal display according to this example.

In the drawing, reference numeral 315 designates signal lines of the output section of the dedicated IC serving as a data supply circuit. Number of the signal lines is 3n corresponding to number of bits, and $\mathbf{315}_1$ to $\mathbf{315}_{3n}$ bits are provided. Each n bit is formed of each of the three colors, red, green and blue. Numeral 316 designates a comparator-detector circuit for comparing polarity of bit provided on the dedicated IC side. Numeral 317 designates a control circuit A on the dedicated IC side serving as a first control circuit, and to which signals of green and blue are inputted. This control circuit A 317 controls the outputs of green and blue by a control signal A from the comparator-detector circuit 316. Numeral 318 designates a control circuit B serving as a second circuit on the source driver IC side being a drive circuit, and to which output of the control circuit A 317 and signal of red are inputted. This control circuit B 317 controls the input of red and the output signal of the control circuit A 317 by the signal A from the comparator-detector circuit 316. Numeral 319 designates a data processing circuit on the source driver side, and to which outputs of the red signal line and the control circuit B 318 are inputted.

Delivery of data in the liquid crystal display of above arrangement is performed in the following manner.

The red signal line is wired in the comparator-detector circuit 316, and comparison with the green or blue signal line is performed for each bit. Only when signal lines of each bit of green and blue are coincident to the signal line of red bit in the aspect of polarity, the control signal A which is an output of the comparator-detector circuit 316 becomes "1" and delivered to the control signal A 317. In addition, a group in which red, green and blue are compared for each bit is formed in the comparator-detector circuit 316.

At this time, when the control signal A from the comparator-detector circuit 316 is "1", the output of the control circuit A 317 for controlling the outputs of green and blue is fixed to LOW, and the data of red, green and blue are represented by the data of red.

The source driver circuit side is also provided with another control circuit B 318, and the control signal A from the comparator-detector circuit 316 is used also to control this circuit. That is, only when the control signal A is "1", the control circuit B 318 is operated, and the data of red is outputted to the data line of green and blue to be delivered to the internal data processing circuit 319.

That is, 3n bit data is replaced by n bit data, thus all data can be covered by ⅓ data.

When polarity of the data is not coincident in the comparator-detector circuit 316, the control signal A becomes "0", and the data of green and blue are outputted to the control circuit A 317 as they are, and inputted to the data processing circuit 319 through the control circuit B 318.

What is claimed is:

1. An integrated circuit for liquid crystal display comprising:

internal clock generating circuitry for generating a plurality of internal clock signals each sequentially delayed and an output clock signal in accordance with an input clock signal; and data latch circuitry for receiving a plurality of display data signals corresponding to a display data input signal each having a respective point of change, said data latch circuitry for outputting the plurality of display data signals each sequentially delayed in accordance with the plurality of internal clock signals, wherein points of changing the plurality of display data signals with respect to a time base are set with time delays that lag one another during one period of a reference internal clock signal, so that number of simultaneous changes of display data output signals is reduced.

2. The integrated circuit for liquid crystal display according to claim 1, wherein the points of changing the plurality of display data signals with respect to the time base are set to points respectively having time delays that lag one another from the active edge of the output clock signal by optional integer times as long as a half period of the data input signal.

3. The integrated circuit for liquid crystal display according to claim 1, wherein the points of changing the plurality of display data signals with respect to the time base are set to points respectively having time delays that lag one another from the active edge of the output clock signal by optional integer times as long as a half period of the display data input signal and by a delay time produced by a delay circuit added to the optional integer times as long as a half period of the display data input signal.

4. An integrated circuit for liquid crystal display characterized in that multi-port data output signals are generated with respect to a data input signal, and points of changing said data output signals with respect to a time base are set with time delays that lag one another during one period of a reference internal clock signal, so that number of simultaneous changes of display data output signals is reduced, wherein the points of changing the data output signals with respect to the time base are set to points respectively delayed from an active edge of the clock output signal by 0.5 period, 1 period, and 1.5 period of the data input signal.

5. A liquid crystal display characterized in that multi-port display data output signals are generated with respect to a data input signal, and points of changing said display data output signals with respect to a time base are set with time delays that lag one another during one period of a clock output signal or a reference internal clock signal having a same phase as the clock output signal, so that number of simultaneous changes of display data output signals is reduced, wherein the points of changing the display data output signals with respect to the time base are set to points respectively delayed from the active edge of the clock output signal by 0.5 period, 1 period, and 1.5 period of the clock input signal or the display data input signal.

* * * * *